US008202137B2

(12) United States Patent
Amireh et al.

(10) Patent No.: US 8,202,137 B2
(45) Date of Patent: Jun. 19, 2012

(54) TOY AIRCRAFT WITH MODULAR POWER SYSTEMS AND WHEELS

(75) Inventors: Nicholas Amireh, Los Angeles, CA (US); Paulo King, Pasadena, CA (US); David Strom, Redondo Beach, CA (US); Chi Keung Chui, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/018,240

(22) Filed: Jan. 31, 2011

(65) Prior Publication Data

US 2011/0130066 A1 Jun. 2, 2011

Related U.S. Application Data

(63) Continuation-in-part of application No. 11/740,391, filed on Apr. 26, 2007, now Pat. No. 7,811,150, and a continuation-in-part of application No. 11/740,216, filed on Apr. 25, 2007, and a continuation of application No. 12/060,040, filed on Mar. 31, 2008, now Pat. No. 7,918,707.

(60) Provisional application No. 60/920,895, filed on Mar. 30, 2007, provisional application No. 61/063,059, filed on Jan. 30, 2008, provisional application No. 60/797,467, filed on May 3, 2006, provisional application No. 60/814,471, filed on Jun. 15, 2006, provisional application No. 60/846,056, filed on Sep. 19, 2006, provisional application No. 60/845,996, filed on Sep. 19, 2006, provisional application No. 60/859,122, filed on Nov. 14, 2006, provisional application No. 60/859,124, filed on Nov. 14, 2006.

(51) Int. Cl.
*A63H 27/00* (2006.01)
*A63H 27/18* (2006.01)

(52) U.S. Cl. ..... 446/34; 446/58

(58) Field of Classification Search ..... 24/706, 24/706.2, 710.5; 446/34, 56, 57, 58, 59, 446/61, 66, 93
See application file for complete search history.

(56) References Cited

U.S. PATENT DOCUMENTS

| | | | | | |
|---|---|---|---|---|---|
| 2,268,487 | A | * | 12/1941 | Jacobs | 446/62 |
| 4,494,940 | A | * | 1/1985 | Gretz | 446/61 |
| 4,591,114 | A | * | 5/1986 | Block | 244/120 |
| 4,655,720 | A | * | 4/1987 | Renger et al. | 446/61 |
| 4,895,541 | A | * | 1/1990 | Miller | 446/57 |
| 5,853,312 | A | * | 12/1998 | Li | 446/61 |

* cited by examiner

*Primary Examiner* — John Ricci
(74) *Attorney, Agent, or Firm* — Kolisch Hartwell, PC

(57) ABSTRACT

Toy aircraft may include an airframe, a modular power system, first and second wheel supports, and first and second wheels. The modular power system may be configured for selective use with and selective removal from the airframe. The power system may include a propulsion unit operable to propel the toy aircraft and a power unit, which may include an energy source configured to supply energy to the propulsion unit. The airframe may include a fuselage, a propulsion unit mount, which may be disposed on the airframe and configured to removably retain the propulsion unit, and a power unit mount, which may be disposed on the fuselage and configured to removably retain the power unit. The first and second wheel supports may extend from the power unit mount toward respective first and second wheel mounts to which the first and second wheels may be rotatably mounted.

18 Claims, 12 Drawing Sheets

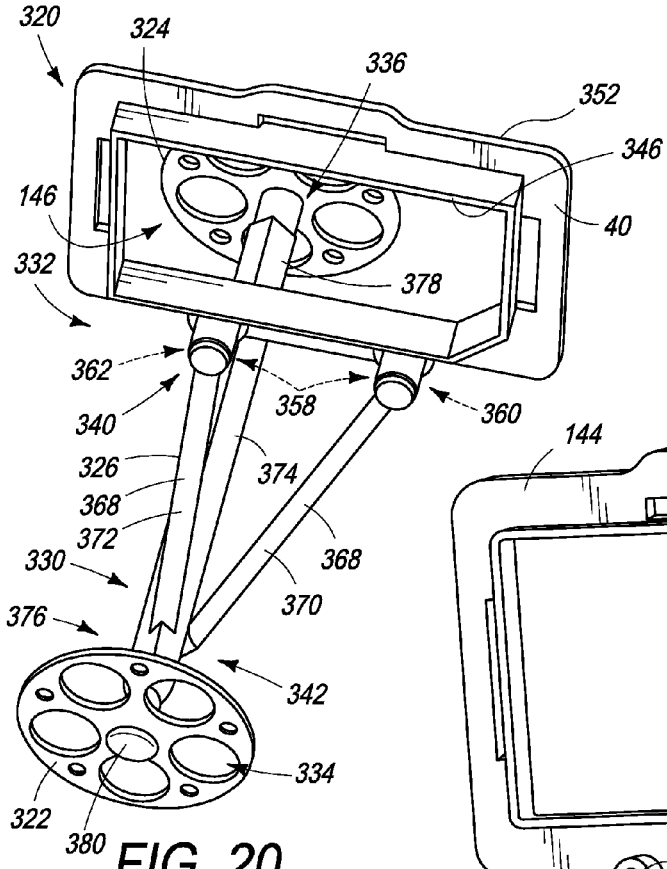
FIG. 20
FIG. 21
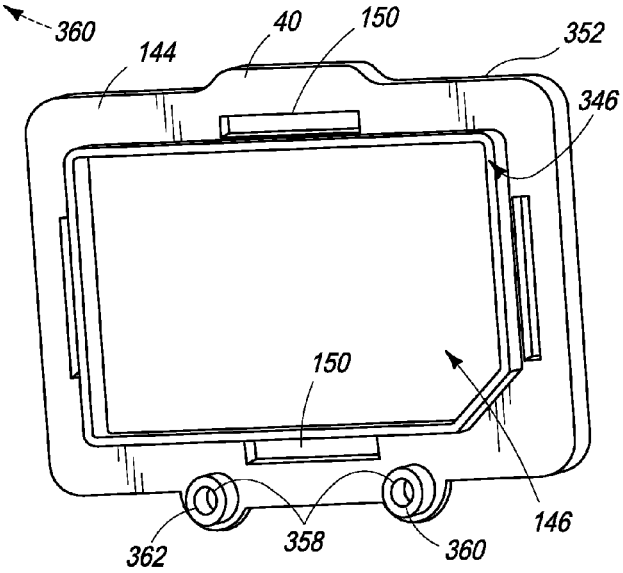
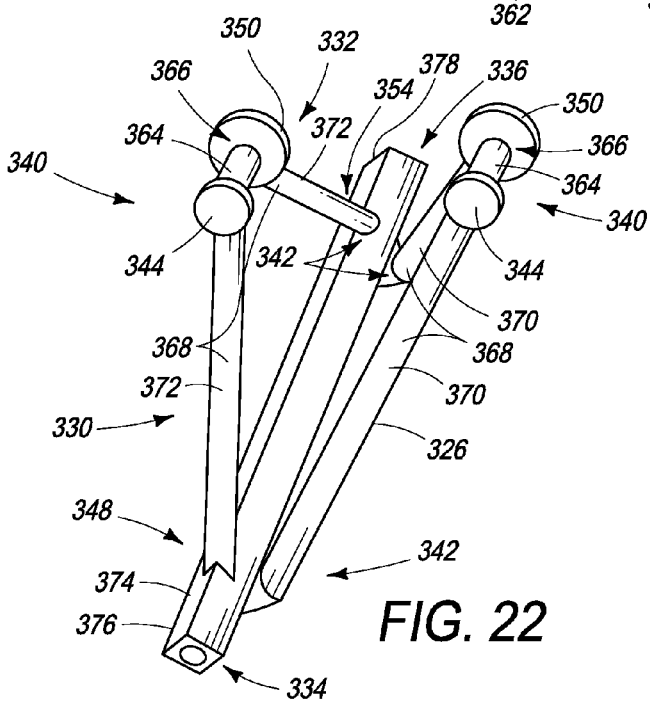
FIG. 22

TOY AIRCRAFT WITH MODULAR POWER SYSTEMS AND WHEELS

This application claims priority to U.S. Provisional Patent Application Ser. Nos. 60/920,895, filed on Mar. 30, 2007 and entitled "MODULAR TOY AIRCRAFT WITH WHEELS," and 61/063,059, filed on Jan. 30, 2008 and entitled "MODULAR TOY AIRCRAFT WITH WHEELS;" this application is a continuation-in-part of U.S. patent application Ser. No. 11/740,391, which was filed on Apr. 26, 2007 now U.S. Pat. No. 7,811,150 and claimed priority to U.S. Provisional Patent Application Ser. Nos. 60/797,467, filed on May 3, 2006, 60/814,471, filed on Jun. 15, 2006, 60/846,056, filed on Sep. 19, 2006, and 60/859,122, filed on Nov. 14, 2006; this application is a continuation-in-part of U.S. patent application Ser. No. 11/740,216, which was filed on Apr. 25, 2007 and claimed priority to U.S. Provisional Patent Application Ser. Nos. 60/797,467, filed on May 3, 2006, 60/814,471, filed on Jun. 15, 2006, 60/846,056, filed on Sep. 19, 2006, 60/845,996, filed on Sep. 19, 2006, 60/859,122, filed on Nov. 14, 2006, and 60/859,124, filed on Nov. 14, 2006; and this application is a continuation of U.S. patent application Ser. No. 12/060,040, which was filed on Mar. 31, 2008 now U.S. Pat. No. 7,918,707 and claimed priority to U.S. Provisional Patent Application Ser. Nos. 60/797,467, filed on May 3, 2006, 60/814,471, filed on Jun. 15, 2006, 60/846,056, filed on Sep. 19, 2006, and 60/859,122, filed on Nov. 14, 2006. The complete disclosures of the above-identified patent applications are hereby incorporated by reference in their entirety for all purposes.

BACKGROUND OF THE DISCLOSURE

Examples of remotely controlled aircraft are disclosed in U.S. Pat. Nos. 3,957,230, 4,206,411, 5,035,382, 5,046,979, 5,078,638, 5,087,000, 5,634,839, 6,612,893, 7,073,750 and 7,275,973, and in U.S. Patent Application Publication Nos. 2004/0195438, 2006/0144995, and 2007/0259595. Examples of remotely controlled aircraft utilizing differential thrust for flight control are disclosed in U.S. Pat. Nos. 5,087,000, 5,634,839, 6,612,893 and 7,275,973 and U.S. Patent Application Publication No. 2007/0259595. Examples of toy aircraft fabricated from interconnected flat panels are disclosed in U.S. Pat. Nos. 2,347,561, 2,361,929, 3,369,319, 4,253,897, 5,853,312, 6,217,404, 6,257,946, and 6,478,650 and U.S. Patent Application Publication Nos. 2007/0259595 and 2008/0014827. Examples of toy aircraft powered by rechargeable capacitors are disclosed in U.S. Pat. No. 6,568,980, U.S. Patent Application Publication No. 2008/0014827, and in International Publication No. WO 2004/045735. Examples of toy aircraft with wheels are disclosed in U.S. Pat. Nos. 2,124,992, 2,131,490, 2,437,743, 2,855,070, 3,699,708, 3,871,126, 5,087,000, and 5,525,087. The complete disclosures of these and all other publications referenced herein are incorporated by reference in their entirety for all purposes.

SUMMARY OF THE DISCLOSURE

In some examples, toy aircraft may include an airframe, a modular power system, first and second wheel supports, and first and second wheels. The modular power system may be configured for selective use with and selective removal from the airframe. The power system may include a propulsion unit that may be operable to propel the toy aircraft and a power unit that may include an energy source configured to supply energy to the propulsion unit. The airframe may include a fuselage, a propulsion unit mount, and a power unit mount.

The propulsion unit mount may be disposed on the airframe and configured to removably retain the propulsion unit. The power unit mount may be disposed on the fuselage and configured to removably retain the power unit. The first and second wheel supports may extend from the power unit mount toward respective first and second wheel mounts. The first and second wheels may be rotatably mounted to respective ones of the first and second wheel mounts.

In some examples, toy aircraft may include an airframe, a wheel assembly, and a modular power system. The airframe may include a fuselage, a propulsion unit mount, and a power unit mount. The propulsion unit mount may be disposed on the airframe. The power unit mount may be disposed on the fuselage and include first and second sides. The wheel assembly may include first and second wheel supports and first and second wheels. The first wheel support may extend from the first side of the power unit mount toward a first wheel mount spaced from the power unit mount. The first wheel may be rotatably mounted to the first wheel mount. The second wheel support may extend from the second side of the power unit mount toward a second wheel mount spaced from the power unit mount. The second wheel may be rotatably mounted to the second wheel mount. The modular power system may be configured for selective use with and selective removal from the airframe. The power system may include a propulsion unit and a power unit. The propulsion unit may be operable to propel the toy aircraft. The propulsion unit mount may be configured to removably retain the propulsion unit relative to the airframe. The power unit may include an energy source configured to supply energy to the propulsion unit. The power unit mount may be configured to removably retain the power unit proximate the fuselage.

In some examples, toy aircraft may include an airframe, a modular power system, a wheel support element, and first and second wheels. The airframe may include a fuselage having first and second sides, a wing connected to the fuselage, first and second motor unit mounts, and a power unit mount. The wing may include first and second portions extending from the respective first and second sides of the fuselage. The first motor unit mount may be disposed on the first portion of the wing. The second motor unit mount may be disposed on the second portion of the wing. The power unit mount may be disposed on the fuselage. The power unit mount may include first and second sides and an opening. The modular power system may be configured for selective use with and selective removal from the airframe. The power system may include a first motor unit, a first propeller driven by the first motor unit, a second motor unit, a second propeller driven by the second motor unit, and a power unit. The first motor unit mount may be configured to removably retain the first motor unit relative to the wing. The second motor unit mount may be configured to removably retain the second motor unit relative to the wing. The power unit may include an energy source configured to supply energy to the first and second motor units. The opening may be configured to removably receive and retain the power unit proximate the fuselage. The wheel support element may be connected to the power unit mount and may include a first wheel support, a second wheel support, and an axle. The first wheel support may extend from the first side of the power unit mount to a first distal end, and the second wheel support may extend from the second side of the power unit mount to a second distal end. The axle may have first and second ends. The axle may be connected to the first and second wheel supports proximate the respective first and second distal ends. The first and second wheels may be rotatably mounted to the axle proximate respective ones of the first and second ends of the axle.

BRIEF DESCRIPTION OF THE DRAWINGS

FIG. 20 is a perspective view of the wheel assembly and power unit mount of the toy aircraft of FIG. 19.

FIG. 21 is a perspective view of the power unit mount of the toy aircraft of FIG. 19.

FIG. 22 is a perspective view of the wheel support element of the toy aircraft of FIG. 19.

DETAILED DESCRIPTION

Figure 1:
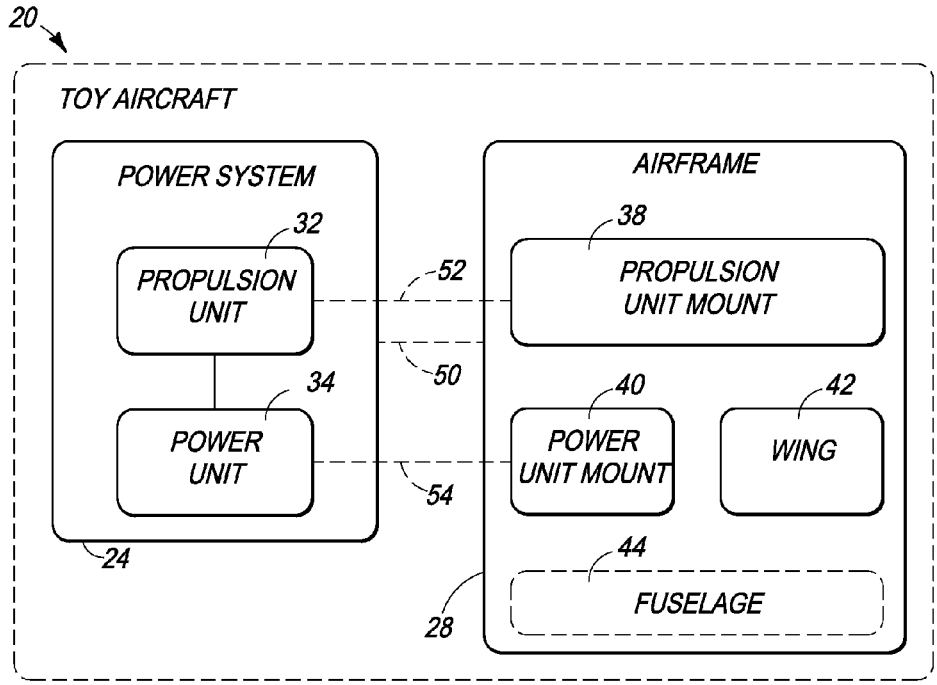
FIG. 1 is a block diagram of a toy aircraft.

A nonexclusive illustrative example of a toy aircraft according to the present disclosure is shown schematically in FIG. 1 and indicated generally at 20. Unless otherwise specified, toy aircraft 20 may, but is not required to, contain at least one of the structure, components, functionality, and/or variations described, illustrated, and/or incorporated herein. A toy aircraft 20 according to the present disclosure may include a power system 24 and an airframe 28.

As shown in the nonexclusive illustrative example presented in FIG. 1, power system 24 may include at least one propulsion unit 32 and a power unit 34. As will be more fully discussed below, power unit 34 may be configured to supply power to, and/or to at least partially control, the at least one propulsion unit 32 such that the at least one propulsion unit 32 is operable to propel toy aircraft 20. As indicated in solid lines in FIG. 1, it is within the scope of the present disclosure for power system 24 to be a discrete or self-contained power system for a toy aircraft. By "discrete," it is meant that the discrete component is not integrally formed with the other component even though the components thereafter may be coupled or otherwise secured together. By "self-contained," it is meant that the self-contained component is adapted to exist and/or at least partially function as a complete or stand-alone unit. For example, a self-contained component may be adapted to exist and/or at least partially function independent of any components external to the self-contained component. Thus, a self-contained power system, such as power system 24, may be adapted to exist and/or function as a complete or stand-alone unit that is independent of a particular toy aircraft 20 and/or a particular airframe 28. For example, as shown in the nonexclusive illustrative example of a self-contained power system presented in FIG. 1, power system 24 may include one or more discrete but linked and/or connected units, such as at least one propulsion unit 32 and a power unit 34, that is/are adapted to be mated to, and/or engaged with, a suitable airframe 28.

As shown in the nonexclusive illustrative example presented in FIG. 1, airframe 28 may include at least one first or propulsion unit mount 38, at least one second or power unit mount 40, and at least one wing 42. In some examples, airframe 28 may additionally or alternatively include at least one fuselage 44. Thus, it is within the scope of the present disclosure for toy aircraft 20 to have at least one wing and at least one fuselage, to have at least one wing and no fuselage, such as where toy aircraft 20 is configured as a flying-wing aircraft, or to have no wing and at least one fuselage, such as where toy aircraft 20 is a helicopter.

Each of the at least one propulsion unit mounts 38 may be disposed on the airframe 28 and configured to removably retain at least one propulsion unit relative to airframe 28. By "removably," it is meant that, even though the retaining component is capable of optionally permanently retaining the retained component, the retained component may optionally be repeatedly retained by and/or removed from the retaining component without permanent and/or destructive alteration to the retaining component, the retained component, and/or the engagement therebetween. In some nonexclusive illustrative examples of toy aircraft 20, at least one of the at least one propulsion unit mounts 38 may be configured to removably retain at least one propulsion unit relative to the wing 42.

The power unit mount 40 may be configured to removably retain at least one power unit relative to airframe 28. In some nonexclusive illustrative examples of toy aircraft 20 that include at least one fuselage 44, the power unit mount 40 may be configured to removably retain at least one power unit relative to at least one of the at least one fuselages of toy aircraft 20.

As indicated in dashed lines in FIG. 1, a toy aircraft 20 according to the present disclosure may be formed, created, and/or assembled when a power system 24 is mated to, and/or engaged with, a suitable airframe 28. A suitable airframe 28 may be any airframe configured to removably retain a power system 24, as indicated by line 50. For example, as shown in the nonexclusive illustrative example presented in FIG. 1, a suitable airframe 28 may include at least one propulsion unit mount 38 configured to removably retain at least one of the at least one propulsion units 32 of power system 24, as indicated by line 52, and at least one power unit mount 40 configured to removably retain the power unit 34 of power system 24, as indicated by line 54.

In some nonexclusive illustrative examples, power system 24 may be a self-contained modular power system for a toy aircraft. By "modular," it is meant that the modular system includes one or more components, where at least a portion of each component has a predetermined geometry that is configured to engage and be retained by a corresponding mount on and/or in a structure that may be discrete from the modular system. A self-contained modular power system 24 may be configured for selective use with and/or selective removal from a suitably configured airframe 28. For example, a propulsion unit 32 of a self-contained modular power system may be configured to engage and be removably retained on any suitable airframe 28 by a corresponding propulsion unit mount 38, which is configured to engage and removably retain the propulsion unit 32. Correspondingly, a power unit 34 of a self-contained modular power system may be configured to engage and be removably retained on any suitable airframe 28 by a corresponding power unit mount 40, which is configured to engage and removably retain the power unit 34.

Figure 2:
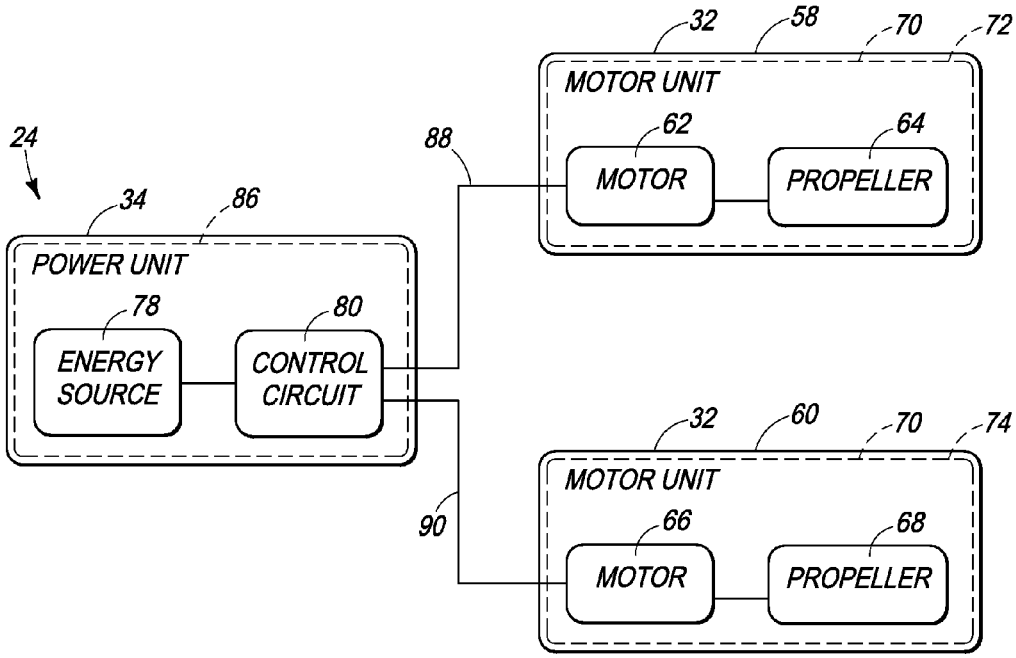
FIG. 2 is a block diagram of a modular power system suitable for use with the toy aircraft of FIG. 1.

A nonexclusive illustrative example of a self-contained or modular power system according to the present disclosure is shown schematically in FIG. 2 and indicated generally at 24. Unless otherwise specified, power system 24 may, but is not required to, contain at least one of the structure, components, functionality, and/or variations described, illustrated, and/or incorporated herein. A modular power system 24 according to the present disclosure may include a power and control or power unit 34 and at least one propulsion unit 32. As shown in the nonexclusive illustrative example presented in FIG. 2, modular power system 24 may include a pair of propulsion units 32, such as a first propulsion or motor unit 58 and a second propulsion or motor unit 60.

Each of the propulsion units 32 may include a motor and a thrust generating device, such as one or more propellers or ducted fans, that is driven by the motor. For example, as shown in the nonexclusive illustrative example presented in FIG. 2, first motor unit 58 may include a first motor 62, which drives a first propeller 64, and second motor unit 60 may include a second motor 66, which drives a second propeller 68. In some nonexclusive illustrative examples, at least one of the first and second motors may be an electric motor. In some nonexclusive illustrative examples, at least one of the propulsion units 32 may include a housing 70. For example, the first motor unit 58 may include a first housing 72 within which the first motor 62 is at least partially disposed. The second motor unit 60 may include a second housing 74 within which the second motor 66 is at least partially disposed.

Power unit 34 may include an energy source 78 and, in some nonexclusive illustrative examples, a control circuit 80. As shown in the nonexclusive illustrative example presented in FIG. 2, the energy source 78 is connected to the control circuit 80 and/or to at least one of the first and second motors 62, 66, such that energy source 78 is configured to provide or supply energy to the control circuit 80 and/or to at least one of the first and second motors 62, 66. In some nonexclusive illustrative examples, power unit 34 may include a housing 86 within which energy source 78 and/or control circuit 80 may be at least partially disposed.

In some nonexclusive illustrative examples, energy source 78 may be a source of electric energy and/or current with at least one of the first and second motors 62, 66 being an electric motor. When energy source 78 is a source of electric energy and/or current, energy source 78 may be electrically connected to the control circuit 80 and/or to at least one of the first and second motors 62, 66, such that energy source 78 may be configured to provide or supply electric energy and/or current to the control circuit 80 and/or to at least one of the first and second motors 62, 66. In some nonexclusive illustrative examples, energy source 78 may be an electrical storage device. For example, energy source 78 may be a battery, which may be rechargeable, a capacitor, or the like. In some nonexclusive illustrative examples, energy source 78 may be an electrical energy generation or production device. For example, energy source 78 may be a fuel cell, a solar cell, or the like.

The first and second motor units 58, 60 may be connected to the power unit 34 with respective first and second pairs 88, 90 of electrical conducting members. As suggested in FIG. 2, the first and second pairs 88, 90 of electrical conducting members may electrically connect the respective first and second motors 62, 66 to the control circuit 80. In some nonexclusive illustrative examples, the first and second pairs 88, 90 of electrical conducting members may be flexible. For example, the first and second pairs 88, 90 of electrical conducting members may include pairs of flexible metal wires.

With regard to power system 24 it is within the scope of the present disclosure for the connections between the first and second motor units 58, 60 and the power unit 34 to be limited to flexible members when power system 24 is separated from airframe 28. For example, as shown in the nonexclusive illustrative example presented in FIG. 6, the connections between the first and second motor units 58, 60 and the power unit 34 may be limited to the first and second pairs 88, 90 of electrical conducting members. However, it should be understood that, even when the connections between the first and second motor units 58, 60 and the power unit 34 are limited to flexible members, power system 24 may include flexible connections other than the first and second pairs 88, 90 of electrical conducting members. Further, the power system 24, including the electrical connections between the first and second motor units 58, 60 and the power unit 34, may be configured for removal from the airframe 28 without electrically disconnecting the first and second motor units 58, 60 from the energy source 78.

In some nonexclusive illustrative examples, the first and second pairs 88, 90 of electrical conducting members may be insulated. For example, the first and second pairs 88, 90 of electrical conducting members may include pairs of insulated wires. In some nonexclusive illustrative examples, the individual wires in each pair of insulated wires may be separate, such as where the two individual wires in each pair are twisted together. In some nonexclusive illustrative examples, the individual wires in each pair of insulated wires may be paired together, such as within a common sheath, conduit or other enclosing member.

When a self-contained or modular power system according to the present disclosure, such as the modular power system 24 schematically presented in FIG. 2, is integrated with a suitable airframe 28 to form a toy aircraft, such as the toy aircraft 20 schematically presented in FIG. 1, the modular power system is then adapted to propel the toy aircraft 20 and to control its flight. For example, as illustrated in the nonexclusive illustrative example presented in FIG. 2, control circuit 80, which connects the energy source 78 to the first and second motors 62, 66 of the first and second motor units 58, 60, may be configured to selectively deliver, or regulate the delivery of, energy from energy source 78 to the first and second motor units 58, 60. In nonexclusive illustrative examples of power system 24 where energy source 78 is a source of electric energy and/or current, control circuit 80 may be configured to selectively deliver, or regulate the delivery of, electric energy and/or current from energy source 78 to the first and second motor units 58, 60. Delivery or supply of energy and/or current from energy source 78 to the first and second motor units 58, 60 renders motor units 58 and 60 operable to propel a toy aircraft 20 on which the modular power system 24 is removably retained. Further, by selectively delivering or supplying energy and/or current to motor units 58 and 60, control circuit 80 is thus configured to control operation of the first and second motor units 58, 60 and thereby control flight of a toy aircraft 20 on which the modular power system 24 is removably retained.

A modular power system 24, such as the one schematically presented in FIG. 2, may be adapted to at least partially control the flight of a toy aircraft 20 on which the modular power system 24 is removably retained, such as through the use of differential thrust from the first and second motor units 58, 60. For example, control circuit 80 may control the flight of toy aircraft 20 by selectively delivering, or regulating the delivery of, energy and/or current from energy source 78 to the first and second motor units 58, 60. Control circuit 80 may cause toy aircraft 20 to perform various flight maneuvers by jointly and/or independently varying the thrust output from the first and second motor units 58, 60. The degree of control that may be achieved with differential thrust from the first and second motor units 58, 60 may be sufficient such that traditional movable aerodynamic control surfaces may be partially or entirely omitted from toy aircraft 20 such that the flight of toy aircraft 20 may be controlled solely by controlling the thrust from the first and second motor units 58, 60.

An aircraft that is controllable by differential thrust, such as toy aircraft 20, may be referred to as propulsion controlled aircraft ("PCA"). The pitch (which generally corresponds to up-and-down motion) of a PCA may be controlled by concurrently increasing or decreasing the energy and/or current supplied to the first and second motor units 58, 60 to produce a concurrent increase or decrease in the thrust output from the first and second motor units 58, 60. For example, increasing the energy and/or current supplied to both the first and second motor units 58, 60 may cause toy aircraft 20 to enter a climb in addition to increasing the speed of the aircraft. Conversely, decreasing the energy and/or current supplied to both the first and second motor units 58, 60 may cause toy aircraft 20 to slow and enter a descent. Toy aircraft 20 may be made to turn by increasing the energy and/or current supplied to one of the first and second motor units 58, 60 relative to the energy and/or current supplied to other of the first and second motor units 58, 60, which causes differential thrust output from the first and second motor units 58, 60 and turning flight. For example, if the thrust output of first motor unit 58 is higher than the thrust output of second motor unit 60, toy aircraft 20 may yaw and roll toward the second motor unit 60, which may result in a turn toward the second motor unit 60. Conversely, a higher thrust output from second motor unit 60, may cause toy aircraft 20 to yaw and roll toward the first motor unit 58, which may result in a turn toward the first motor unit 58.

Figures 3, 4:
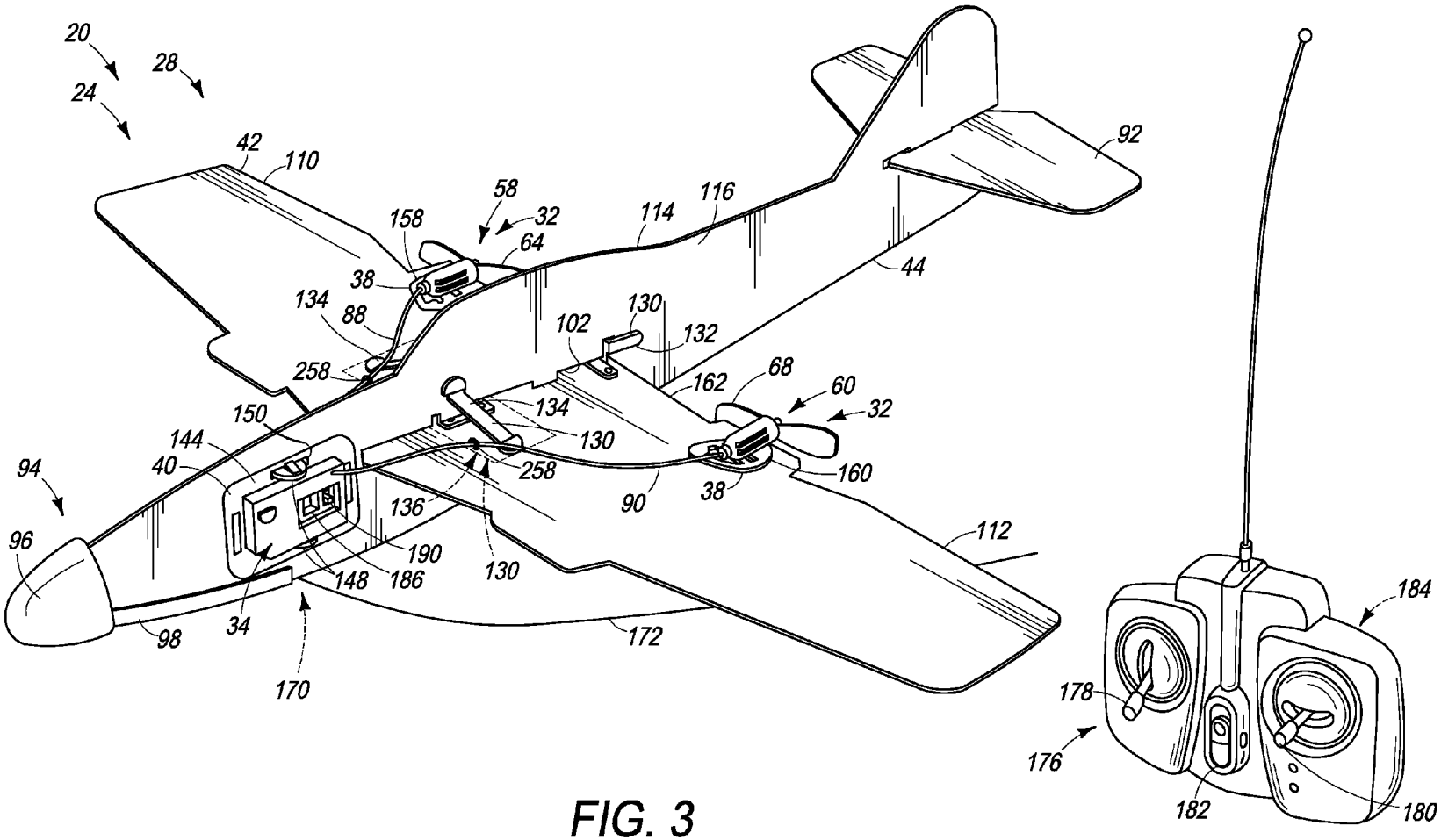
FIG. 3 is a perspective view of a toy aircraft incorporating a modular power system.
FIG. 4 is a perspective view of a nonexclusive illustrative example of a remote control transmitter suitable for use with some nonexclusive illustrative examples of toy aircraft, such as the toy aircraft of FIG. 3.
Figure 5:
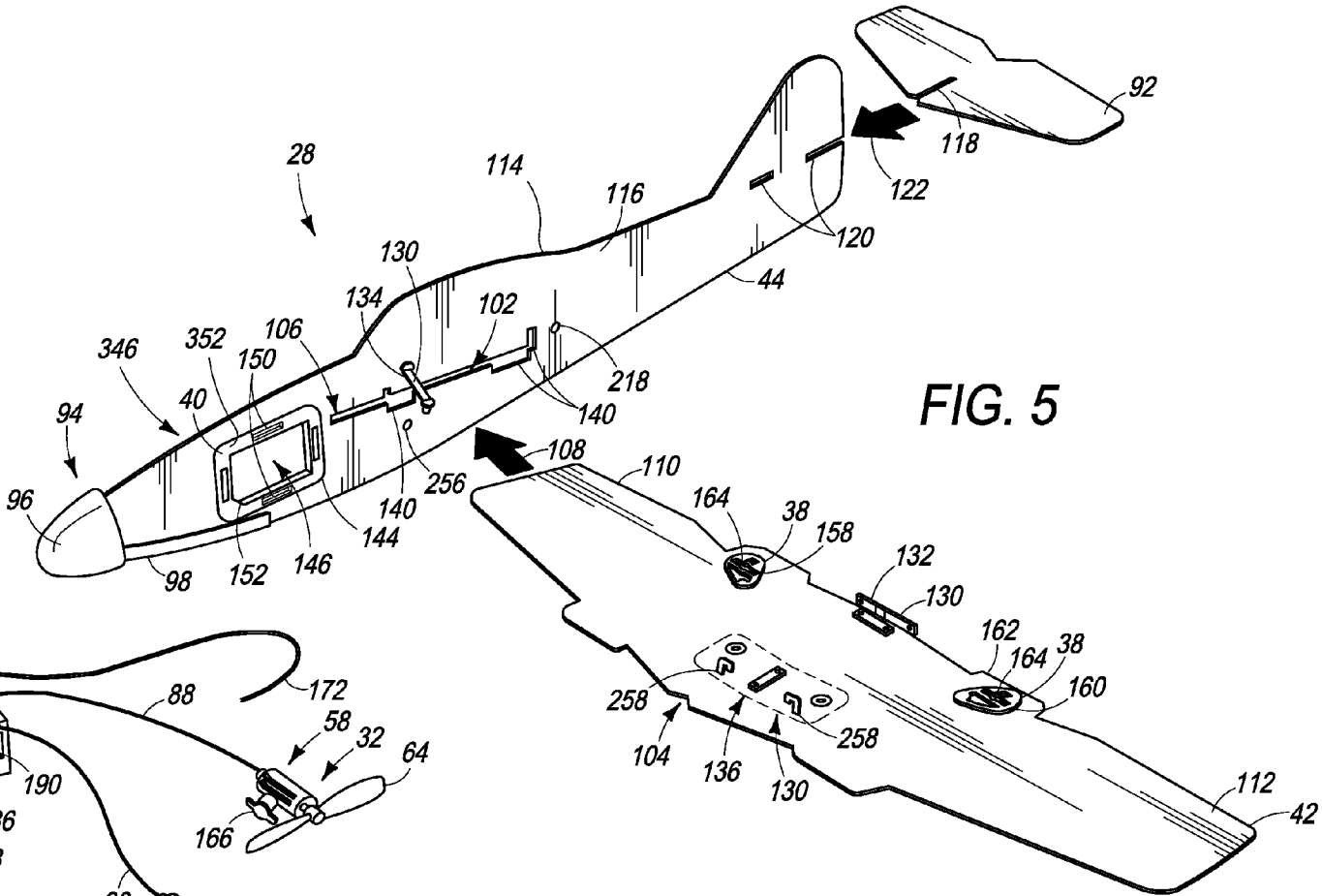
FIG. 5 is an exploded view of the airframe of the toy aircraft of FIG. 3.

Another nonexclusive illustrative example of a toy aircraft according to the present disclosure is shown in FIGS. 3 and 5 and indicated generally at 20. Unless otherwise specified, toy aircraft 20 may, but is not required to, contain at least one of the structure, components, functionality, and/or variations described, illustrated, and/or incorporated herein. As shown in the nonexclusive illustrative example presented in FIGS. 3 and 5, toy aircraft 20 may be configured as a modular toy aircraft that includes a power system 24, such as the nonexclusive illustrative example presented in FIG. 6, that is removably retained to an airframe 28.

As shown in the nonexclusive illustrative example presented in FIGS. 3 and 5, at least a portion of one or more of the airframe components, such as wing 42, fuselage 44, and horizontal stabilizer 92 (if present), may be fabricated from at least one flat panel of material. Suitable flat panels of material may include wood, cardboard, extruded polystyrene or other polymer-based panels. In some nonexclusive illustrative examples, some airframe components may be completely formed from a flat panel of material. For example, as shown in the nonexclusive illustrative example presented in FIGS. 3 and 5, airframe 28 may include a horizontal stabilizer 92 that is fabricated from a flat panel of material.

In some nonexclusive illustrative examples, at least a portion of at least one of the airframe components may be fabricated from an at least partially resilient material, such as an expanded polypropylene foam. For example, as shown in the nonexclusive illustrative example presented in FIGS. 3 and 5, a nose portion 94 of the fuselage 44 may be include a nose cone 96 having an increased thickness relative to the fuselage 44. In some nonexclusive illustrative examples, nose cone 96 may be fabricated from expanded polypropylene foam.

In some nonexclusive illustrative examples, one or more of the airframe components may include a protective element. Such a protective element may be configured to provide enhanced structural integrity and/or abrasion resistance to at least a portion of the airframe component on which it is disposed or affixed. For example, as shown in the nonexclusive illustrative example presented in FIGS. 3 and 5, the fuselage 44 may include at least one skid protector 98. Such a skid protector 98 may be fabricated from an injection molded plastic and secured to the fuselage 44 using a suitable method or mechanism, such as friction, adhesive, and/or one or more mechanical fasteners, such as pins extending at least partially through at least a portion of the fuselage 44.

In some nonexclusive illustrative examples where airframe 28 is assembled from components that are fabricated from flat panels of material, at least some of the airframe components may be at least partially frictionally retained relative to each other. For example, wing 42 and and/or horizontal stabilizer 92 may be at least partially frictionally retained relative to fuselage 44. As shown in the nonexclusive illustrative example presented in FIG. 5, fuselage 44 may include an aperture or slot 102 that is configured to at least partially frictionally receive the wing 42. The frictional engagement between the wing 42 and the slot 102 may be enhanced if one or more of the dimensions of slot 102 are slightly smaller than a corresponding dimension of wing 42. For example, the height of slot 102 may be slightly smaller than the thickness of wing 42. In some nonexclusive illustrative examples, wing 42 may include a structural feature, such as detent 104, that is configured to engage a corresponding portion of slot 102, such as the front end 106 of the slot. As shown in the nonexclusive illustrative example presented in FIG. 5, wing 42 may be connected to the fuselage 44 by inserting wing 42, as indicated by arrow 108, through slot 102 until first and second portions 110, 112 of the wing 42 extend from the respective first and second sides 114, 116 of the fuselage 44.

Where airframe 28 includes a horizontal stabilizer 92, the horizontal stabilizer 92 may be at least partially frictionally retained relative to the fuselage. For example, as shown in the non-exclusive example presented in FIG. 5, the horizontal stabilizer 92 may be connected to the fuselage 44 by engaging the corresponding slots 118 and 120 on the respective ones of the horizontal stabilizer 92 and the fuselage 44, as indicated by arrow 122. In some nonexclusive illustrative examples, the horizontal stabilizer 92 may be connected to the fuselage 44 by transversely inserting the horizontal stabilizer 92 through a slot in the fuselage 44, such as similar to the wing installation illustrated in FIG. 5. In some nonexclusive illustrative examples, the horizontal stabilizer 92 may be connected to the fuselage 44 by a combination of transverse insertion and longitudinal motion. For example, as illustrated in the nonexclusive example presented in FIG. 16, which will be more fully discussed below, the horizontal stabilizer 92 may be connected to the fuselage 44 by initially inserting the horizontal stabilizer 92 into a corresponding slot 124, as indicated by arrow 126, followed by rearward translation of the horizontal stabilizer 92 relative to the fuselage 44, as indicated by arrow 128.

In some nonexclusive illustrative examples, airframe 28 may include one or more structural elements or reinforcing members 130 configured to at least partially support the wing 42 relative to the fuselage 44. In some nonexclusive illustrative examples, at least one of the one or more reinforcing members 130 may be fabricated as an injection or otherwise molded plastic clip. Reinforcing members 130 may be configured to at least partially retain the wing 42 in a predetermined position relative to the fuselage 44. For example, as illustrated in the nonexclusive illustrative example presented in FIGS. 3 and 5, at least one reinforcing member 130 may be configured as a laterally-supporting wing clip 132, which will be more fully described below with respect to FIG. 7. Reinforcing members 130 may also and/or alternatively be configured to at least partially maintain the wing 42 in a predetermined orientation relative to the fuselage 44. For example, as illustrated in the nonexclusive illustrative example presented in FIGS. 3 and 5, at least one reinforcing member 130 may be configured wing strut 134. Reinforcing members 130 may also and/or alternatively be configured to at least partially induce a dihedral into the wing 42. By "dihedral," it is meant the upward angle of a wing, from the fuselage or wing root to the wing tip, from a line that is perpendicular to the fuselage. For example, as illustrated in the nonexclusive illustrative example presented in FIGS. 3 and 5, at least one reinforcing member 130 may be configured as a wing support clip 136, which will be more fully described below with respect to FIG. 8.

When airframe 28 includes one or more reinforcing members 130, the fuselage 44 and/or the wing 42 may be configured to provide clearance for the reinforcing members 130 during connection of the wing 42 to the fuselage 44. For example, as shown in the nonexclusive illustrative example presented in FIG. 5, slot 102 may include one or more enlarged regions 140 to clear the reinforcing members 130.

Figure 6:
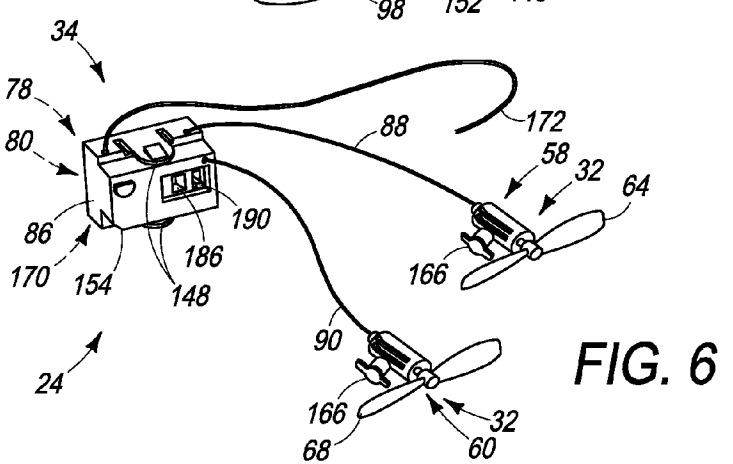
FIG. 6 is a perspective view of a modular power system suitable for use with toy aircraft, such as the toy aircraft and airframe of FIGS. 3 and 5.

Nonexclusive illustrative examples of suitable mounts for attaching a power system 24, such as the nonexclusive illustrative example presented in FIG. 6, to an airframe 28 are illustrated in FIGS. 3 and 5. Unless otherwise specified, the mounts for attaching power system 24 to an airframe 28, such as those illustrated in FIGS. 3 and 5, may, but are not required to, contain at least one of the structure, components, functionality, and/or variations described, illustrated, and/or incorporated herein.

As shown in the nonexclusive illustrative example presented in FIG. 5, the power unit mount 40 may be configured as a receptacle 144 disposed on the fuselage 44. The receptacle 144 may be configured to removably retain the power unit 34 relative to the airframe 28 and fuselage 44. For example, receptacle 144 may include an opening 146 that is configured to removably receive at least a portion of power unit 34, such as at least a portion of the housing 86, as shown in FIG. 3. Further, the opening 146, power unit 34, and/or the fuselage 44 may be configured such that the power unit 34 is disposed at least partially external to the fuselage 44 when it is retained in the opening 146.

The power unit 34 may include at least one barbed tab 148, as shown in FIG. 6, that is configured to engage a corresponding opening 150 on receptacle 144, as shown in FIG. 5, such that power unit 34 is retained by the receptacle 144, as shown in FIG. 3. In some nonexclusive illustrative examples, opening 146 may be configured to nondestructively removably receive at least a portion of power unit 34. By "nondestructively," it is meant that the nondestructively engaged elements are not damaged during nondestructive engagement or disengagement.

In some nonexclusive illustrative examples, the opening 146 may extend fully through the power unit mount 40, such as between the first and second sides 346, 352 of the power unit mount, as shown in FIGS. 5 and 21. The opening 146 may extend through the fuselage 44 from the first side 114 of the fuselage 44 to the second side 116 of the fuselage 44, as shown in FIG. 5.

In some nonexclusive illustrative examples, the opening 146 of power unit mount 40 may be configured to receive the housing 86 of the power unit 34 in a predetermined orientation. As such, opening 146 and housing 86 may include one or more asymmetric features such that housing 86 may be received in opening 146 in a predetermined orientation, such as with a particular end of housing 86 oriented towards the nose portion 94 of the fuselage 44. For example, at least one corner of opening 146 may be angled in correspondence with at least one corner of housing 86 such that opening 146 is configured to receive housing 86 in a limited number of orientations. As shown in the nonexclusive illustrative example presented in FIGS. 5 and 6, a single corner 152 of opening 146 may be angled in correspondence with a single corner 154 of housing 86 such that opening 146 is configured to receive housing 86 in a single predetermined orientation.

As shown in the nonexclusive illustrative example presented in FIG. 5, the propulsion unit mounts 38 may be configured as first and second motor unit mounts 158, 160. The first and second motor unit mounts 158, 160 may be disposed on the respective first and second portions 110, 112 of wing 42, such as proximate the trailing edge 162 of wing 42. Each of the first and second motor unit mounts 158, 160 may be configured to removably receive and retain one of the first and second motor units 58, 60. In some nonexclusive illustrative examples, the first and second motor unit mounts 158, 160 may be configured to nondestructively removably receive and retain the first and second motor units 58, 60. For example, each of the first and second motor unit mounts 158, 160 may include a receptacle, such as an aperture 164, as shown in FIG. 5, that is configured to receive a portion of one of the first and second motor units 58, 60, such as a mounting foot 166, as shown in FIG. 6. The details of the engagement between the first and second motor units 58, 60 and the first and second motor unit mounts 158, 160 will be more fully discussed below with respect to FIGS. 9-14.

In some nonexclusive illustrative examples, toy aircraft 20 may be configured as a remotely controlled toy aircraft. For example, power system 24 may include a receiver 170 that is electrically connected to control circuit 80. In such an example, control circuit 80 may be configured to regulate current and/or energy supplied from energy source 78 to at least one of the first and second motor units 58, 60, such as in response to an external signal received by the receiver. In some nonexclusive illustrative examples, toy aircraft 20 may be configured as a radio-controlled (RC) toy aircraft 20 with receiver 170 being a radio receiver that is electrically connected to control circuit 80. In some nonexclusive illustrative examples, radio receiver 170 may be disposed in power unit 34, with an antenna 172 extending therefrom, as shown in FIGS. 3 and 6. The detailed operation of remotely controlled aircraft, including remotely controlled PCA are well known in the art and will not be discussed in detail herein. Further details regarding the operation of remotely controlled PCA may be found in U.S. Pat. Nos. 5,087,000 and 6,612,893, the complete disclosures of which are incorporated by reference in their entirety for all purposes.

When toy aircraft 20 is configured as an RC toy aircraft 20, it may be paired with a suitable transmitter, such as the nonexclusive illustrative example transmitter 176 shown in FIG. 4. Transmitter 176 may include one or more input devices, such as first and second control sticks 178, 180. The detailed operation of a remote control transmitter, such as transmitter 176, is well known in the art and will not be discussed in detail herein. Transmitter 176 may include a power switch 182. In some nonexclusive illustrative examples, transmitter 176 may be configured to recharge the energy source 78 of power system 24. For example, transmitter 176 may include an appropriate charging connector 184 that is configured to interface with a charging connector 186 on power system 24, such as on the power unit 34. In some nonexclusive illustrative examples where transmitter 176 is configured to recharge the energy source 78, power switch 182 may be configured to select between an ON mode (for remote control transmission), an OFF mode, and a recharge mode. In some nonexclusive illustrative examples, such as where power system 24 includes a rechargeable energy source 78, power system 24 may include a power switch 190. Power switch 190 may be configured to disconnect one or more of the first and second motors 62, 66 and/or control circuit 80 from energy source 78, such as during recharging of energy source 78.

Figure 7:
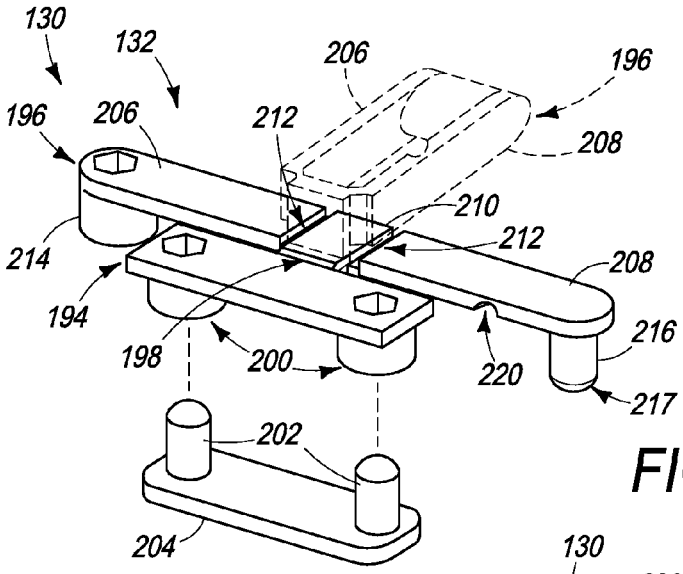
FIG. 7 is a detail view of a nonexclusive illustrative example of a laterally-supporting wing clip suitable for use with toy aircraft, such as the toy aircraft and airframe of FIGS. 3 and 5.

A nonexclusive illustrative example of a laterally-supporting wing clip 132 is illustrated in FIG. 7. Unless otherwise specified, the laterally-supporting wing clip 132, may, but is not required to, contain at least one of the structure, components, functionality, and/or variations described, illustrated, and/or incorporated herein. Clip 132, which may be fabricated from a molded plastic, includes a first or wing engaging portion 194 and a second or fuselage engaging portion 196. As shown in the nonexclusive illustrative example presented in FIG. 7, the wing engaging portion 194 may be connected to the fuselage engaging portion 196 by a region of reduced thickness 198. Such a region of reduced thickness 198 forms a living hinge, which enables the fuselage engaging portion 196 to be bent, such as out of plane, relative to the wing engaging portion 194, as suggested in dashed lines in FIG. 7.

As shown in the nonexclusive illustrative example presented in FIG. 7, the wing engaging portion 194 of clip 132 may include at least one socket 200 that is configured to extend through a corresponding hole in a wing 42, as suggested in FIGS. 3 and 5. Each of the at least one sockets 200 may be configured to frictionally and/or mechanically engage a corresponding pin 202 on a backing clip 204. When wing engaging portion 194 and backing clip 204 are engaged through corresponding holes in wing 42, as suggested in FIGS. 3 and 5, clip 132 is retained relative to wing 42.

As shown in the nonexclusive illustrative example presented in FIG. 7, the fuselage engaging portion 196 of clip 132 may include first and second arms 206, 208. The first and second arms 206, 208 may be connected to a central portion 210 of the fuselage engaging portion 196 by regions of reduced thickness 212, which may provide living hinges that enable bending of the first and second arms 206, 208 relative to the central portion 210, as suggested in dashed lines in FIG. 7. As shown in the nonexclusive illustrative example presented in FIG. 7, respective ones of the first and second arms 206, 208 may include a socket 214 and a corresponding pin 216, which is configured for frictional and/or mechanical engagement with socket 214. Mechanical engagement between pin 216 and socket 214 may occur where at least a portion of pin 216, such as an end portion 217, has at least one larger radial dimension than socket 214. When the socket 214 and pin 216 of the first and second arms 206, 208 are brought into frictional and/or mechanical engagement through an appropriate hole in fuselage 44, such as the hole 218 illustrated in FIG. 5, clip 132 is retained relative to fuselage 44, as shown in FIG. 3. In some nonexclusive illustrative examples one or more of the first and second arms 206, 208 may include a region of reduced thickness 220, which may at least partially facilitate engagement of pin 216 with socket 214.

Figure 8:
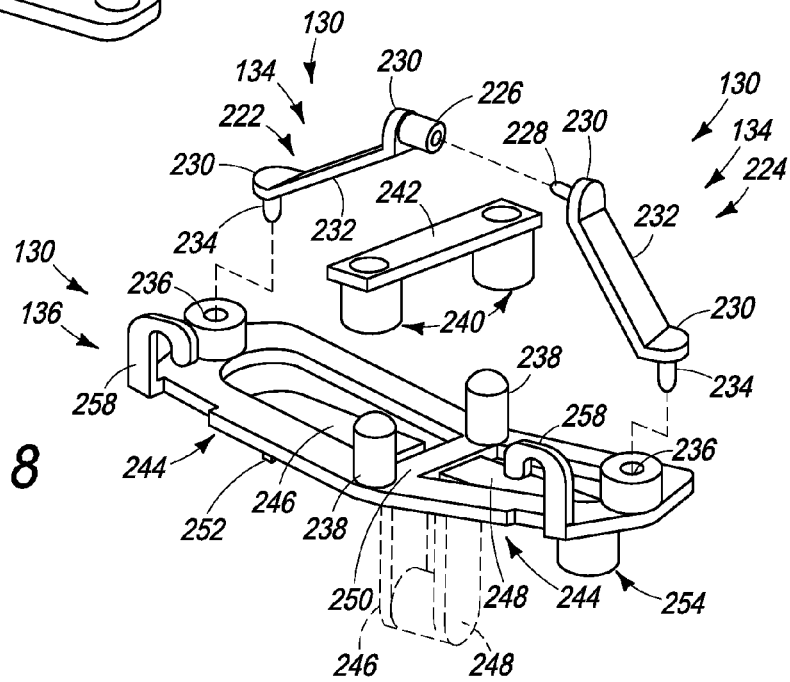
FIG. 8 is a detail view of a nonexclusive illustrative example of a wing support clip and struts suitable for use with toy aircraft, such as the toy aircraft and airframe of FIGS. 3 and 5.

Nonexclusive illustrative examples of wing struts 134 and a wing support clip 136 are presented in FIG. 8. Unless otherwise specified, wing struts 134 and wing support clip 136, may, but are not required to, contain at least one of the structure, components, functionality, and/or variations described, illustrated, and/or incorporated herein.

Wing struts 134 may be configured as a first wing strut 222 or a second wing strut 224, as suggested in the nonexclusive illustrative examples presented in FIG. 8. The first wing strut 222 may include a socket 226 and second wing strut 224 may include a pin 228, where socket 226 is configured to frictionally and/or mechanically engage and retain pin 228. When the first and second wing struts 222, 224 are engaged though a corresponding hole in the fuselage 44, as suggested in FIGS. 3 and 5, the first and second wing struts 222, 224 are retained relative to fuselage 44. In some nonexclusive examples, the end regions 230 of struts 134 may be flexibly connected to the central portion 232 of the strut, such as by regions of reduced thickness, which may form at least one living hinge. Each of the first and second wing struts 222, 224 may include a pin 234 that is configured to engage a corresponding socket 236 on the wing support clip 136.

As shown in the nonexclusive illustrative example presented in FIG. 8, wing support clip 136 may include at least one pin 238 that is configured to extend through a corresponding hole in a wing 42, as suggested in FIGS. 3 and 5. Each of the at least one pins 238 may be configured to frictionally and/or mechanically engage a corresponding socket 240 on a backing clip 242. When wing support clip 136 and backing clip 242 are engaged through corresponding holes in wing 42, as suggested in FIGS. 3 and 5, wing support clip 136 is retained relative to wing 42. In some nonexclusive illustrative examples, such as for the wing support clip 136 shown in FIG.

8, the outer portions 244 of the wing support clip 136 may be angled relative to each other, rather than being coplanar. Thus, if such a wing support clip 136 is secured to the lower surface of a wing, as shown in the nonexclusive illustrative example, presented in FIGS. 3 and 5 (with sockets 236 and pins 238 extending through the wing), a dihedral angle will be induced into the wing. Conversely, if such a wing support clip 136 is secured to the upper surface of a wing (with sockets 236 and pins 238 extending through the wing), an anhedral angle will be induced into the wing.

As shown in the nonexclusive illustrative example presented in FIG. 8, wing support clip 136 may include first and second arms 246, 248. The first and second arms 246, 248 may be connected to a central portion 250 of wing support clip 136 by regions of reduced thickness, which may provide living hinges that enable bending of the first and second arms 246, 248 relative to the central portion 250, as suggested in dashed lines in FIG. 8. As shown in the nonexclusive illustrative example presented in FIG. 8, respective ones of the first and second arms 246, 248 may include a pin 252 and a corresponding socket 254, which is configured for frictional and/or mechanical engagement with pin 252. When the pin 252 and corresponding socket 254 of the first and second arms 246, 248 are brought into frictional and/or mechanical engagement through an appropriate hole in fuselage 44, such as the hole 256 illustrated in FIG. 5, wing support clip 136 is retained relative to fuselage 44.

In some nonexclusive illustrative examples, the airframe 28 may be configured to at least partially retain and/or restrain at least one of the first and second pairs of electrical conducting members 88, 90 relative to the airframe. For example, one or more retention devices, such as hooks 258, may be provided on wing 42, such that the first and second pairs of electrical conducting members 88, 90 may be at least partially retained and/or restrained relative to the wing 42, as illustrated in FIGS. 3 and 5. In some nonexclusive illustrative examples, the hooks 258 may be incorporated into the wing support clip 136, as shown in FIG. 8.

Figure 12:
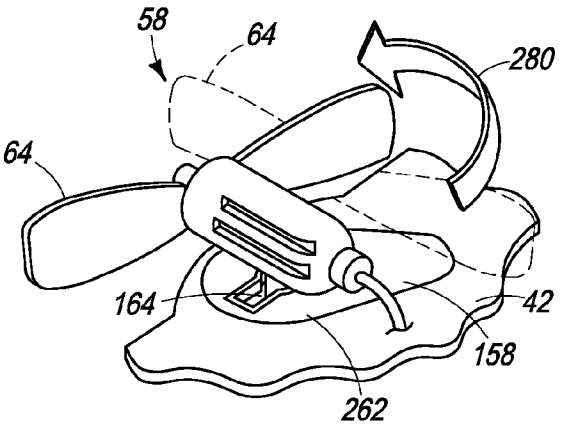
FIG. 12 is a motor side perspective view illustrating the first motor unit of FIG. 9 rotated into an operative orientation.
Figure 13:
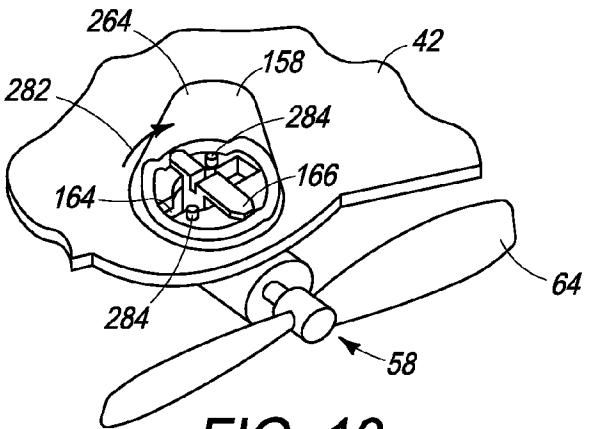
FIG. 13 is a rear side perspective view illustrating the first motor unit of FIG. 9 rotated into the operative orientation illustrated in FIG. 12.
Figure 14:
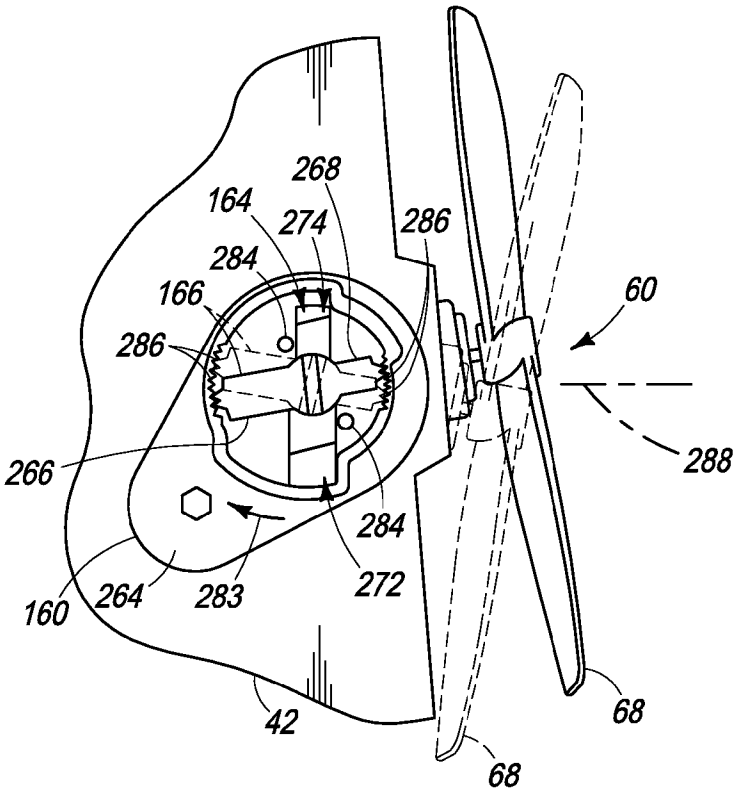
FIG. 14. is a rear side view of a second motor unit, which corresponds to the first motor unit of FIG. 9, rotated into one of a plurality of operative orientations relative to a second motor unit mount.

Nonexclusive illustrative examples of first and second motor units 58, 60, such as the first and second motor units 58, 60 of the nonexclusive illustrative example of a power system 24 shown in FIG. 6, being mounted to, or mounted to, first and second motor unit mounts 158, 160 are presented FIGS. 9-14. In particular, a nonexclusive illustrative example of mounting a first motor unit 58 to a first motor unit mount 158 is shown in FIGS. 9-13, and a nonexclusive illustrative example of a second motor unit 60 mounted to a second motor unit mount 160 is shown in FIG. 14. Unless otherwise specified, first motor unit 58, first motor unit mount 158, second motor unit 60 and second motor unit mount 160 may, but are not required to, contain at least one of the structure, components, functionality, and/or variations described, illustrated, and/or incorporated herein. As shown or suggested in the nonexclusive illustrative examples presented in FIGS. 9-14, each of the first and second motor units 58, 60 may include a mounting foot 166 and each of the first and second motor unit mounts 158, 160 may include an aperture 164 that extends from a first or motor side 262 to a second or rear side 264. The apertures 164 on the first and second motor unit mounts 158, 160 may be configured to receive the mounting foot 166 of a corresponding one of the first and second motor units 58, 60.

The first or motor side 262 and the second or rear side 264 of the first and second motor unit mounts 158, 160 should not be understood to refer to a particular side of the wing 42. Rather, the first or motor side 262 refers to the side of the motor unit mount on which the motor of the motor unit resides when the motor unit is received by the motor unit mount, as will be more fully discussed below. The second or rear side 264 refers to the side of the motor unit mount that is opposite to the first or motor side 262. The first or motor side 262 of at least one motor unit mount may be on an upper surface of wing 42, as illustrated in the nonexclusive illustrative example presented in FIG. 3, or the first or motor side 262 of at least one motor unit mount may be on a lower surface of wing 42, as illustrated in the nonexclusive illustrative example presented in FIG. 15.

In some nonexclusive illustrative examples, the motor unit mounts may be configured to removably receive a corresponding one of the motor units in at least one predetermined orientation relative to the wing 42. When a motor unit is in a predetermined or operative orientation, the propeller may be configured and/or oriented such that the propeller at least partially generates forward thrust for toy aircraft 20, as suggested in FIGS. 3 and 15. For example, as shown in the nonexclusive illustrative examples presented in FIGS. 9-14, the first and second motor unit mounts 158, 160 may be configured to removably receive the respective ones of the first and second motor units 58, 60 in at least one predetermined orientation relative to the wing 42.

As shown in the nonexclusive illustrative examples presented in FIGS. 9-14 the apertures 164 on the first and second motor unit mounts 158, 160 and the mounting feet 166 of the first and second motor units 58, 60 may include one or more asymmetries. Such asymmetries may at least partially limit and/or restrict the possible orientations with which a motor unit mount may receive a motor unit. For example, as shown in the nonexclusive illustrative examples presented in FIGS. 9-14, the mounting foot 166 may include a larger or first end 266 that is relatively wider than a smaller or second end 268. The aperture 164 may correspondingly include a first or larger end 272 to accommodate the first end 266 of the mounting foot 166 and a second or smaller end 274 to accommodate the second end 268 of the mounting foot 166. In some nonexclusive illustrative examples, the respective mounting feet 166 of the first and second motor units 58, 60 may differ. For example, as shown in the nonexclusive illustrative example presented in FIG. 9, the larger or first end 266 of the mounting foot 166 of the first motor unit 58 may be disposed proximate the propeller 64, while the smaller or second end 268 of the mounting foot 166 of the second motor unit 60 may be disposed proximate the propeller 68, as shown in the nonexclusive illustrative example presented in FIG. 14.

Figure 9:
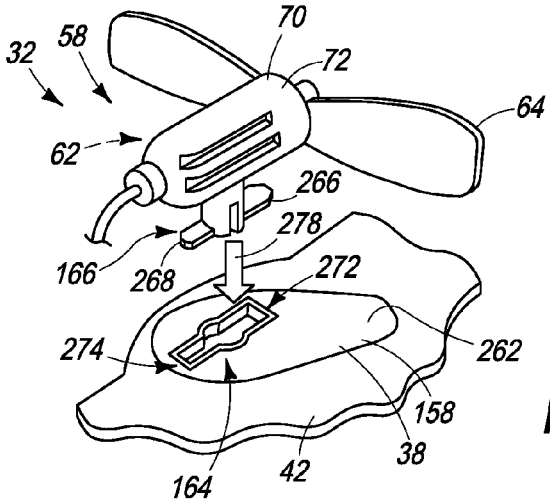
FIG. 9 is a motor side perspective view illustrating installation of a nonexclusive illustrative example of a first motor unit into a nonexclusive illustrative example of a first motor unit mount on the wing of a toy aircraft, such as the toy aircraft and airframe of FIGS. 3 and 5.
Figure 10:
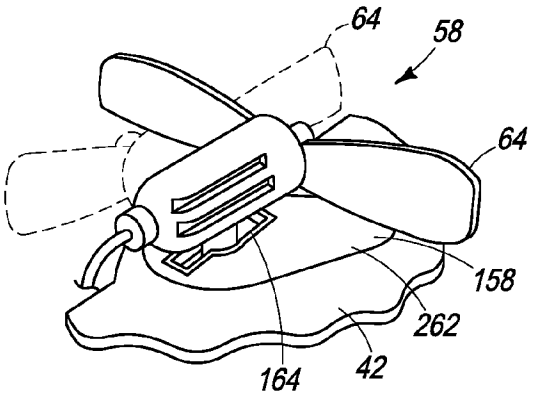
FIG. 10 is a motor side perspective view illustrating the first motor unit of FIG. 9 in a partially installed position.

To engage the first motor unit 58 with the first motor unit mount 158, the first motor unit 58 is positioned over the motor side 262 of aperture 164, as illustrated in FIG. 9, with the first motor unit 58 oriented such that the first and second ends 266, 268 of the mounting foot 166 are aligned with respective ones of the first and second ends 272, 274 of aperture 164. The mounting foot 166 is inserted into the aperture 164, as indicated by arrow 278. When the mounting foot 166 is sufficiently inserted into aperture 164, as shown in FIG. 10, the mounting foot 166 protrudes beyond the rear side 264 of aperture 164, a shown in FIG. 11. Once sufficiently inserted into aperture 164, the first motor unit 58 is rotated relative to the first motor unit mount 158, as indicated by arrow 280 in FIG. 12 (counterclockwise when viewed looking towards the motor side 262) and arrow 282 in FIG. 13 (clockwise when viewed looking towards the rear side 264), until the motor unit 58 is aligned and/or configured to at least partially generate forward thrust. Although the nonexclusive illustrative example presented in FIGS. 9-13 includes rotation in one or more particular directions, it should be understood that other examples may include rotation in an opposite direction and/or other forms of movement such as linear translations. In some nonexclusive illustrative examples, motor unit 58 is aligned and/or configured to at least partially generate forward thrust when the propeller 64 may rotate without impacting the wing 42, as shown in FIGS. 12 and 13.

The second motor unit 60 may be engaged with the second motor unit mount 160 following a similar procedure to that discussed above with respect to the first motor unit 58 and first motor unit mount 158. As suggested in FIG. 14, the second motor unit 60 is oriented such that the first and second ends 266, 268 of the mounting foot 166 are aligned with respective ones of the first and second ends 272, 274 of aperture 164. The mounting foot 166 is inserted into the aperture 164 until the mounting foot 166 protrudes beyond the rear side 264 of aperture 164, and the second motor unit 60 is rotated relative to the second motor unit mount 160, as indicated by arrow 283 in FIG. 14 (clockwise when viewed looking towards the rear side 264), until the motor unit 60 is aligned and/or configured to at least partially generate forward thrust. Although the nonexclusive illustrative example presented in FIG. 14 includes rotation in one or more particular directions, it should be understood that other examples may include rotation in an opposite direction and/or other forms of movement such as linear translations. In some nonexclusive illustrative examples, motor unit 60 is aligned and/or configured to at least partially generate forward thrust when the propeller 68 may rotate without impacting the wing 42, as shown in FIG. 14.

Figure 11:
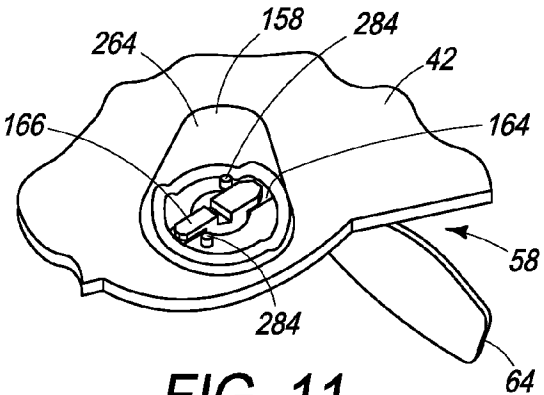
FIG. 11 is a rear side perspective view illustrating the first motor unit of FIG. 9 in the partially installed position illustrated in FIG. 10.

In some nonexclusive illustrative examples, at least one of the first and second motor unit mounts 158, 160 may include one or more rotation restricting devices that limit the rotation of the mounting foot 166 relative to the motor unit mount. For example, the first and second motor unit mounts 158, 160 may include one or more projections or studs 284, as shown in FIGS. 11, 13 and 14. Such rotation restricting devices may be configured to deter and/or preclude undesired rotation of the motor unit. For example, as shown in the nonexclusive illustrative example presented in FIGS. 11 and 13, the studs 284 on the first motor unit mount 158 are configured to prevent rotation of the first motor unit 58 in a direction opposite to that indicated by arrows 280 and 282 and/or rotation of the first motor unit 58 beyond a certain point in the direction indicated by arrows 280 and 282. Such restrictions on rotation of the first motor unit 58 may at least partially preclude the first motor unit mount 158 from receiving and/or retaining the first motor unit 58 in a position and/or orientation in which the first motor unit 58 is rendered inoperative, such as where the wing 42 precludes rotation of the propeller 64. As shown in the nonexclusive illustrative example presented in FIG. 14, the studs 284 on the second motor unit mount 160 are configured to prevent rotation of the second motor unit 60 in a direction opposite to that indicated by arrow 283 and/or rotation of the second motor unit 60 beyond a certain point in the direction indicated by arrow 283. Such restrictions on rotation of the second motor unit 60 may at least partially preclude the second motor unit mount 160 from receiving and/or retaining the second motor unit 60 in a position and/or orientation in which the second motor unit 60 is rendered inoperative, such as where the wing 42 precludes rotation of the propeller 68.

In some nonexclusive illustrative examples, the first motor unit mount 158 may be configured to preclude receiving the second motor unit 60 in a position and/or orientation in which the second motor unit 60 at least partially generates forward thrust and/or the second motor unit mount 160 may be configured to preclude receiving the first motor unit 58 in a position and/or orientation in which the first motor unit 58 at least partially generates forward thrust. For example, as may be observed from comparison of the nonexclusive illustrative examples of the second motor unit 60 and the first motor unit mount 158 presented in FIGS. 9-14, the configuration of the aperture 164 and studs 284 of the first motor unit mount 158 in combination with the orientation of the first and second ends 266, 268 of the mounting foot 166 of the second motor unit 60 may at least partially preclude the first motor unit mount 158 from receiving the second motor unit 60 in a position and/or orientation in which propeller 68 may rotate without impacting the wing 42. As may be observed from comparison of the nonexclusive illustrative examples of the first motor unit 58 and the second motor unit mount 160 that are presented in FIGS. 9-14, the configuration of the aperture 164 and studs 284 of the second motor unit mount 160 in combination with the orientation of the first and second ends 266, 268 of the mounting foot 166 of the first motor unit 58 may at least partially preclude the second motor unit mount 160 from receiving the first motor unit 58 in a position and/or orientation in which the propeller 64 may rotate without impacting the wing 42.

In some nonexclusive illustrative examples, the first motor unit mount 158 may be configured to preclude receiving the second motor unit 60 and/or the second motor unit mount 160 may be configured to preclude receiving the first motor unit 58. For example, the aperture 164 of the first motor unit mount 158 may be configured to preclude receiving the mounting foot 166 of the second motor unit 60 and/or the aperture 164 of the second motor unit mount 160 may be configured to preclude receiving the mounting foot 166 of the first motor unit 58.

In some nonexclusive illustrative examples, the first motor unit mount 158 may be configured to render the second motor unit 60 inoperative if the second motor unit 60 is received by the first motor unit mount 158 and/or the second motor unit mount 160 may be configured to render the first motor unit 58 inoperative if the first motor unit 58 is received by the second motor unit mount 160. For example, the first and second motor units 58, 60 and/or the first and second motor unit mounts 158, 160 may include electrical and/or mechanical interlocks and/or disconnects configured to interrupt or otherwise disable and/or prevent the delivery of power and/or current to the first motor unit 58 when the first motor unit 58 is received by the second motor unit mount 160 and/or to the second motor unit 60 when the second motor unit 60 is received by the first motor unit mount 158.

In some nonexclusive illustrative examples, at least one of the first and second motor unit mounts 158, 160 may be configured to retain the respective one of the first and second motor units 58, 60 in a selected one of a plurality of predetermined orientations. For example, at least one of the first and second motor unit mounts 158, 160 may be configured to retain the respective one of the first and second motor units 58, 60 in a selected one of a plurality of rotational orientations relative to the wing 42 in which the respective one of the first and second propellers 64, 68 at least partially generates forward thrust for toy aircraft 20. As shown in the nonexclusive illustrative example presented in FIG. 14, at least one of the first and second motor unit mounts 158, 160, such as the second motor unit mount 160, may include a plurality of protrusions or teeth 286 that are configured to engage at least one of the first and second ends 266, 268 of mounting foot 166. Such mounting teeth 286 may provide a plurality of predetermined orientations for the motor unit. A nonexclusive illustrative example of a first predetermined orientation of a motor unit is illustrated in solid lines in FIG. 14, and a nonexclusive illustrative example of another predetermined orientation of the motor unit is illustrated in dashed lines in FIG. 14. Although illustrated as a plurality of engagable teeth in the nonexclusive illustrative example presented in FIG. 14, any periodic and/or intermittent series of mechanical detents may be used, such as at least partially overlapping and/or engaged rounded elements.

The plurality of predetermined orientations in which a first or second motor unit 58, 60 may be retained by a corresponding one of the first and second motor unit mounts 158, 160 may range over any suitable angle such as 5 degrees, 10 degrees, 15 degrees, 20 degrees, 30 degrees, or even 45 or more degrees. In some nonexclusive illustrative examples, the angular range of the plurality of predetermined orientations may be symmetric about a plane or axis 288 that is parallel to the fuselage 44. In some nonexclusive illustrative examples, the angular range of the plurality of predetermined orientations may permit relatively greater outward or inward rotation relative to axis 288. For example, where the edge, either forward or rearward, of the wing 42 that is proximate the motor unit mount is swept, either forward or rearward, the angular range of the plurality of predetermined orientations may be selected to exclude orientations in which the propeller would impact the wing 42.

Permitting oblique orientation and/or alignment of at least one of the first and second motor units 58, 60 relative to the wing 42 and/or the fuselage 44 may permit trimming the flight of the toy aircraft 20 based on the corresponding obliquely oriented and/or aligned thrust vector or vectors from the propeller driven by the obliquely oriented motor unit or units. For example, at least one of the first and second motor units 58, 60 may be selectively angled and/or oriented such that the toy aircraft 20 tends to fly straight and/or such that the toy aircraft 20 tends to turn during flight. In some nonexclusive illustrative examples, the effect of the angling of the first and second motor units 58, 60 may vary with the speed and/or attitude of the aircraft. In some nonexclusive illustrative examples, selectively angling and/or orienting at least one of the first and second motor units 58, 60 may permit trimming the flight characteristics of the aircraft, such as to compensate for differing thrust outputs of the left and right motors and/or other conditions that tend to affect flight. For example, the toy aircraft 20 may be trimmed for a desired flight path, such as straight flight, by selectively angling and/or orienting at least one of the first and second motor units 58, 60 to compensate for such conditions as one or more bent portions of airframe 28, such as the wing 42 or the fuselage 44, that induces a left and/or right turning tendency into the toy aircraft 20. In some nonexclusive illustrative examples, selectively angling and/or orienting at least one of the first and second motor units 58, 60 may permit and/or cause the toy aircraft 20 to perform a maneuver, such as a loop, roll, spin, circle, or the like, absent any control input during flight. For example, selectively angling and/or orienting at least one of the first and second motor units 58, 60 may cause the toy aircraft 20 to perform a loop, roll, spin, circle or other maneuver without any external control inputs or signals, such as signals from a remote control transmitter. By selectively angling and/or orienting at least one of the first and second motor units 58, 60 to a greater or lesser extent, the radius of the loop, roll, spin, circle or other maneuver may be selected without any external control inputs or signals.

Figure 15:
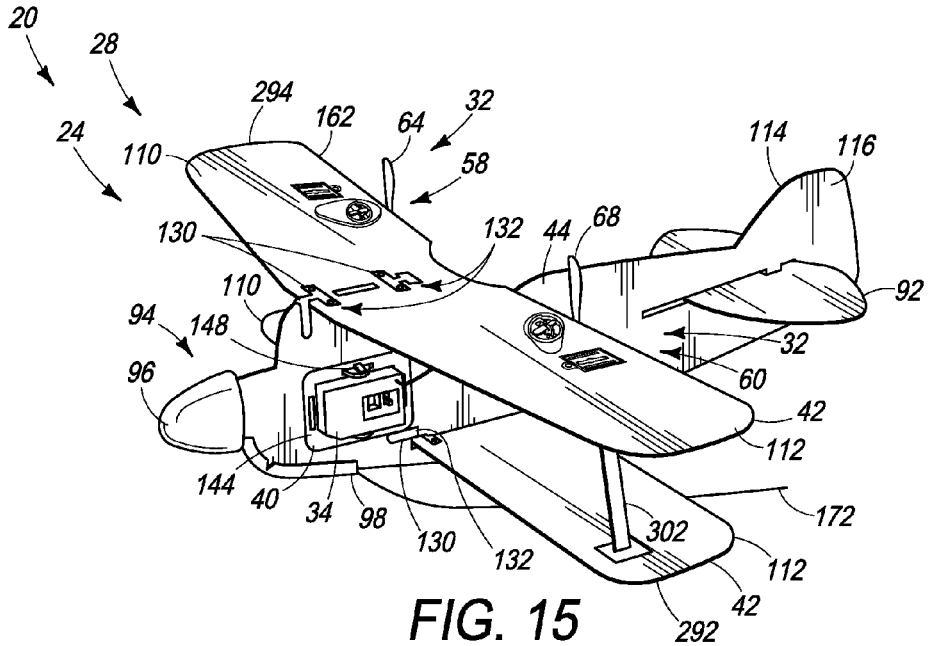
FIG. 15 is a perspective view of another example of a toy aircraft incorporating a modular power system.
Figure 16:
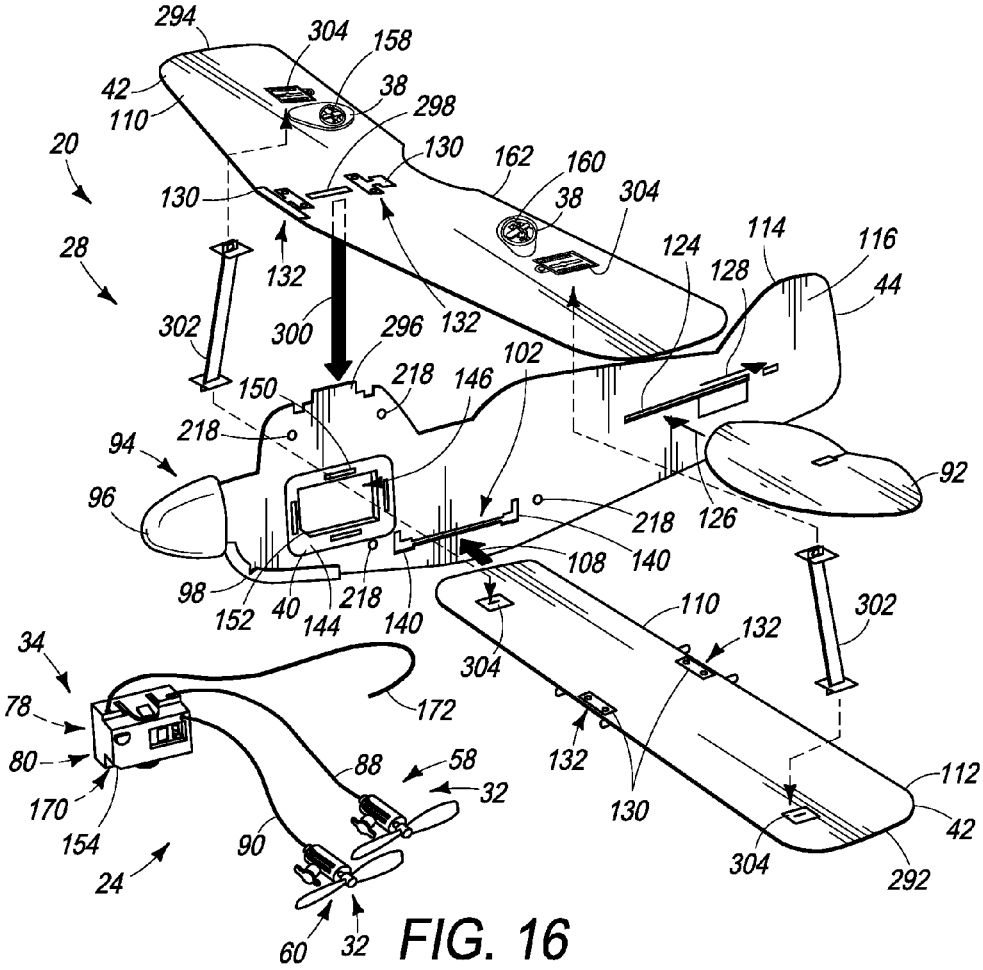
FIG. 16 is an exploded view of the toy aircraft and modular power system of FIG. 15.
Figure 18:
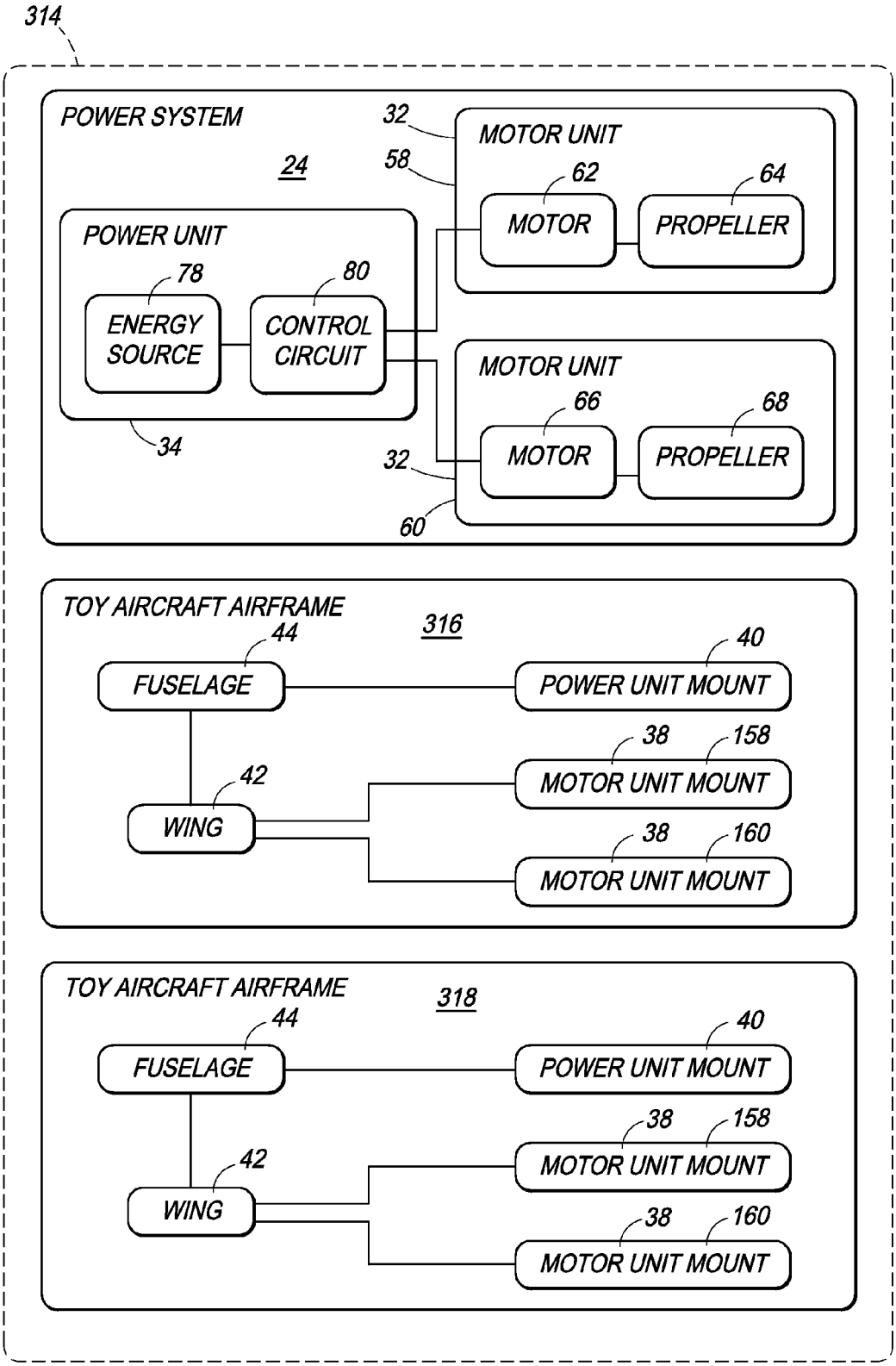
FIG. 18 is a block diagram of a toy aircraft kit, including a modular power system and toy aircraft airframes.

Another nonexclusive illustrative example of a toy aircraft according to the present disclosure is shown in FIGS. 15-16 and indicated generally at 20. Unless otherwise specified, toy aircraft 20 may, but is not required to, contain at least one of the structure, components, functionality, and/or variations described, illustrated, and/or incorporated herein.

As shown in the nonexclusive illustrative example presented in FIGS. 15-16, toy aircraft 20 may include first and second wings 292, 294. The first and second wings 292, 294 may be arranged in any suitable manner relative to the airframe 28 and/or fuselage 44, such as in tandem where one of the first and second wings 292, 294 is forward of the other of the first and second wings 292, 294, or in a biplane configuration, as shown in the nonexclusive illustrative example presented in FIGS. 15-16.

In some nonexclusive illustrative examples, at least one of the first and second wings 292, 294, such as the first wing 292, may generally be attached to the airframe 28 and/or fuselage 44 as generally described above and illustrated in FIG. 16. In some nonexclusive illustrative examples, the second wing 294 may be attached to the airframe 28 and/or fuselage 44 in a manner similar to that for the first wing 292, or it may be installed differently. For example, as shown in the nonexclusive illustrative example presented in FIG. 16, the second wing 294 ay be attached to the airframe 28 and/or fuselage 44 by inserting a portion 296 of the fuselage 44 into a slot 298 in wing 294, as indicated by arrow 300. In some nonexclusive illustrative examples, at least one of the first and second wings 292, 294 may be at least partially supported relative to the fuselage 44 by one or more structural elements or reinforcing members 130, such as the laterally-supporting wing clips 132 shown in FIGS. 15 and 16.

As shown in the nonexclusive illustrative example presented in FIGS. 15-16, the first and second wings 292, 294 may additionally or alternatively be at least partially supported relative to each other and/or relative to the airframe 28 and/or the fuselage 44 by one or more struts 302. The struts 302, which may be uniform or configured into one or more pairs of left and right struts, may engage corresponding sockets 304 on the first and second wings 292, 294, as shown in FIG. 16. As shown in the nonexclusive illustrative example presented in FIG. 17, the sockets 304 may include an aperture 306 that is configured to receive an end 308 of a strut 302. In some nonexclusive illustrative examples, strut 302 may be at least partially retained by an enlarged portion 310 of end 308 that engages a corresponding portion 312 of aperture 306.

Figure 17:
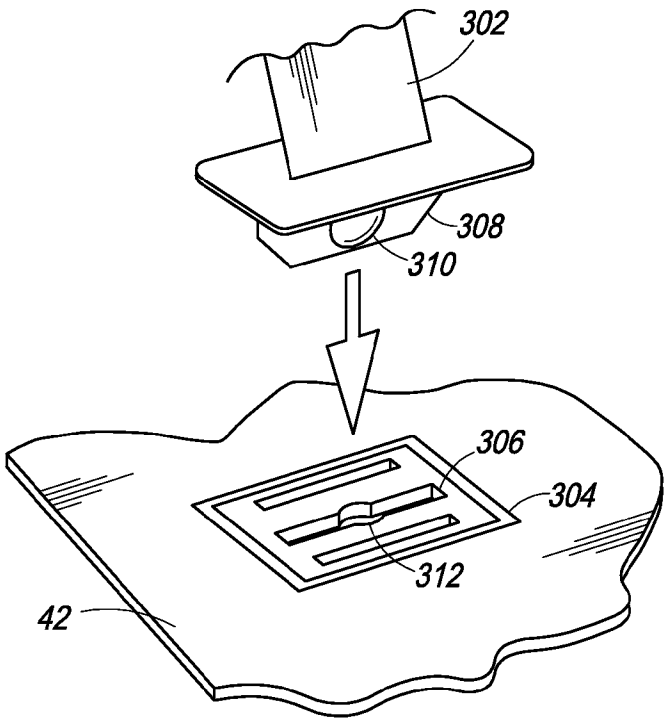
FIG. 17 is a detail view illustrating the connection between a wing strut and a wing of the toy aircraft of FIGS. 15-16.

A nonexclusive illustrative example of a toy aircraft kit 314 according to the present disclosure is shown schematically in FIG. 17. Unless otherwise specified, the toy aircraft kit 314 and any of its component parts may, but are not required to, contain at least one of the structure, components, functionality, and/or variations described, illustrated, and/or incorporated herein. The toy aircraft kit 314 may include a modular power system 24 and first and second toy aircraft airframes 316, 318, each of which may be adapted for selective use with the modular power system 24.

The modular power system 24 may include a power unit 34, a first motor unit 58, and a second motor unit 60. The power unit 34 may include an energy source 72 and a control circuit 74. The first motor unit 58 may include a first motor 62 and a first propeller 64. The second motor unit 60 may include a second motor 66 and a second propeller 68.

The first toy aircraft airframe 316 may include a first fuselage 44, a first wing 42, first and second motor unit mounts 158, 160, and a first power unit mount 40. The first wing 42 may be configured to extend from the first fuselage 44. The first and second motor unit mounts 158, 160 may be disposed on the first wing 42, and may be configured to removably retain respective ones of the first and second motor units 58, 60. The first power unit mount 40 may be disposed on the first fuselage 44, and may be configured to removably retain the power unit 34.

The second toy aircraft airframe 318 may include a second fuselage 44, a second wing 42, third and fourth motor unit mounts 158, 160, and a second power unit mount 40. The second wing 42 may be configured to extend from the second fuselage 44. The third and fourth motor unit mounts 158, 160 may be disposed on the second wing 42, and may be configured to removably retain respective ones of the first and second motor units 58, 60. The second power unit mount 40 may be disposed on the second fuselage 44, and may be configured to removably retain the power unit 34.

In some nonexclusive illustrative examples, the first and second toy aircraft airframes 316, 318, as included in the kit 314, may be at least partially unassembled and/or at least partially disassembled. For example, the first wing 42 may be included in kit 314 while disassembled from the first fuselage 44, and/or the second wing 42 may be included in kit 314 while disassembled from the second fuselage 44.

Figure 19:
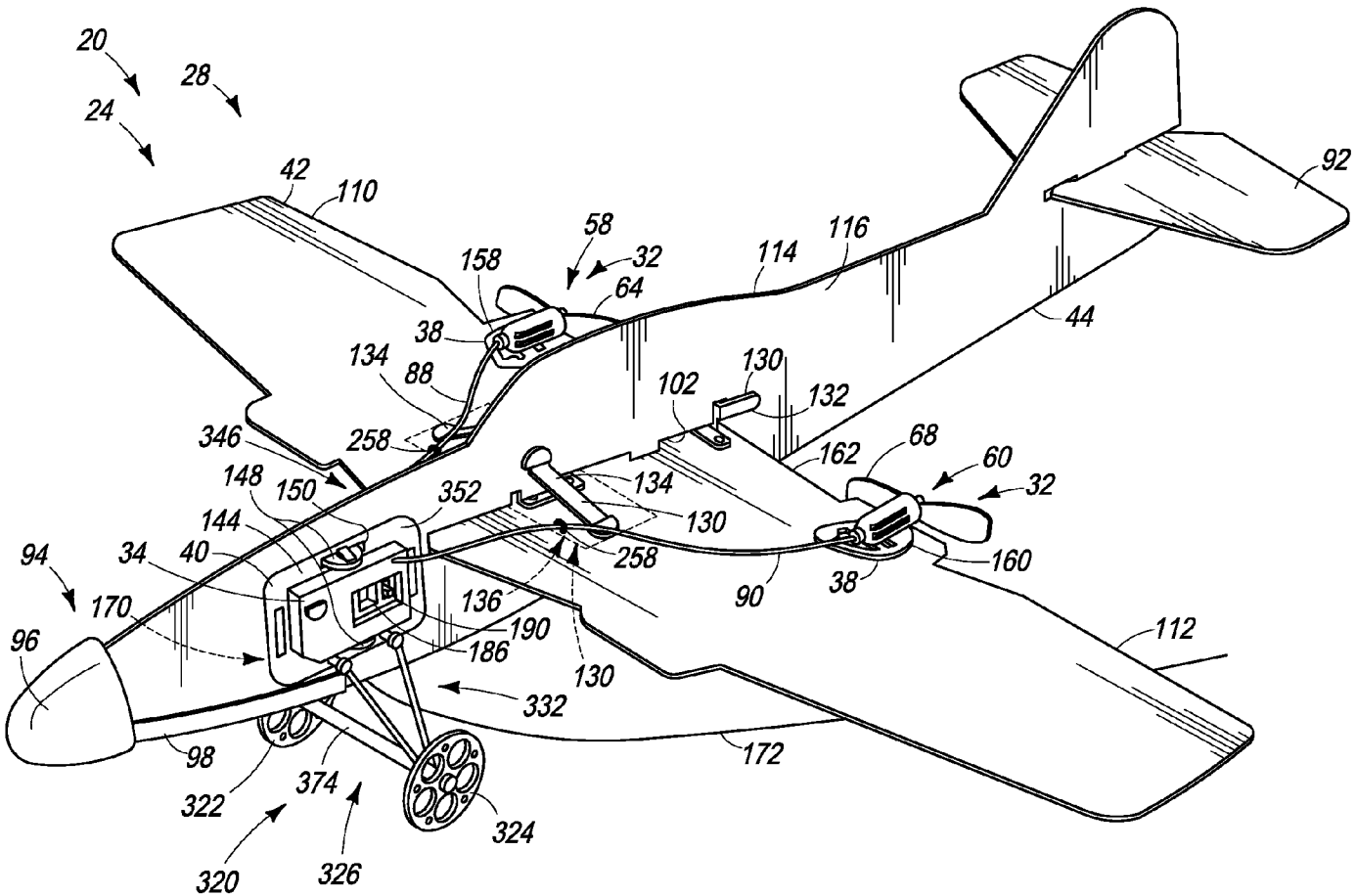
FIG. 19 is a perspective view of a toy aircraft incorporating a modular power system and a nonexclusive illustrative example of a wheel assembly.

In some nonexclusive illustrative examples, the toy aircraft 20 may include a wheel assembly such as the nonexclusive illustrative example shown generally at 320 in FIGS. 19 and 20. Unless otherwise specified, the wheel assembly 320 may, but is not required to, contain at least one of the structures, components, functionalities, and/or variations described, illustrated, and/or incorporated herein. The wheel assembly 320 may include a first wheel 322, a second wheel 324, and a wheel support element 326, which may be connected to the power unit mount 40.

The wheel support element 326 may be configured to support the first and second wheels 324, 326 relative to the power unit mount 40. In some examples, the wheel support element 326, or any of its portions or components may comprise a plastic material, which may be injection molded. The wheel support element 326 may include first and second wheel supports 330, 332 and first and second wheel mounts 334, 336. As shown in the example presented in FIGS. 19 and 20, each of the first and second wheel supports 330, 332 may extend from the power unit mount 40 toward respective first and second wheel mounts 334, 336, which may be spaced from the power unit mount 40.

Each of the first and second wheel supports 330, 332 may extend from a proximal end 340 toward a distal end 342, as shown in FIG. 22. The proximal end 340 may be proximate to and/or connected with the power unit mount 40. For example, as shown in FIG. 20, the first wheel support 330 may extend from a first proximal end 344, which may be at and/or connected to a first side 346 of the power unit mount 40, to a first distal end 348. Likewise, as shown in FIG. 22, the second wheel support 332 may extend from a second proximal end 350, which may be at and/or connected to a second side 352 of the power unit mount 40, to a second distal end 354.

The first proximal end 344 of the first wheel support 330 may be configured to engage or connect with the second proximal end 350 of the second wheel support 332 at and/or through the power unit mount 40. For example, as shown in FIG. 21, the power unit mount 40 may include at least one passage or hole 358, which may extend from a first side 346 of the power unit mount 40 to a second side 352 of the power unit mount 40. As shown in FIGS. 20 and 21, the hole 358 may be proximate the opening 146 in the power unit mount 40, and in some examples, the power unit mount 40 may include first and second or forward and aft holes 360, 362. As shown or suggested in FIGS. 20 and 22, the first proximal end 344 of the first wheel support 330 may include a connecting element or pin 364 that may be configured to extend through one of the holes 358 to the second proximal end 350 of the second wheel support 332. The connecting element or pin 364 may be integral with or bonded to the first proximal end 344. The second proximal end 350 of the second wheel support 332 may include a socket 366 configured to frictionally and/or mechanically receive and/or engage the connecting element or pin 364. In some examples, the connecting element or pin 364 may be adhesively bonded to the second proximal end 350.

In some examples, at least one of the first and second wheel supports 330, 332 may include a plurality of struts 368. For example, as shown in FIGS. 19-22, when the power unit mount 40 includes first and second holes 360, 362, each of the first and second wheel supports 330, 332 may include first and second struts 370, 372. The first struts 370 of the first and second wheel supports 330, 332 may collectively include a pin 364 and a socket 366 configured to frictionally and/or mechanically receive and/or engage the pin 360. For example, the pin 364 may be configured to extend through the first hole 360 from the first strut 370 of the first wheel support 330 to the socket 366 on the first strut 370 of the second wheel support 332. Similarly, the second struts 372 of the first and second wheel supports 330, 332 may collectively include a pin 364 and a socket 366 configured to frictionally and/or mechanically receive and/or engage the pin 360. For example, the pin 364 may be configured to extend through the second hole 362 from the second strut 372 of the first wheel support 330 to the socket 366 on the second strut 372 of the second wheel support 332.

In some examples, the wheel support element 326 may include an axle 374 having first and second ends 376, 378. As shown in FIGS. 20 and 22, the axle 374 may be connected to the first and second wheel supports 330, 332 proximate the distal ends 342. The first and second wheel mounts 334, 336 may be proximate the respective first and second ends 376, 378 of the axle 374 such that the first and second wheels 322, 324 may be rotatably mounted proximate the respective first and second ends 376, 378 of the axle 374. For example, as shown in FIG. 20, the first and second wheels 322, 324 may be rotatably mounted to the respective first and second ends 376, 378 of the axle 374 by way of a pin or pins 380. Each pin 380 may be frictionally, mechanically, and/or adhesively attached to the first and/or second ends 376, 378 of the axle 374.

Another nonexclusive illustrative example of a wheel assembly for the toy aircraft 20 is shown generally at 384 in FIGS. 23-27. Unless otherwise specified, the wheel assembly 384 may, but is not required to, contain at least one of the structures, components, functionalities, and/or variations described, illustrated, and/or incorporated herein. The wheel assembly 384 may include a first wheel 322, a second wheel 324, and a wheel support element 386, which may be connected to the power unit mount 40.

The wheel support element 386 may be in the form of an elongate member formed to an appropriate shape. For example, as suggested in FIGS. 24 and 25, the wheel support element 386 may be a formed metal wire or rod. The wheel support element 386 may include first and second wheel supports 330, 332 that have first and second distal ends 348, 354 configured for rotatable mounting of the first and second wheels 322, 324. Caps 388 may be provided to retain the first and second wheels 322, 324 on the first and second distal ends 348, 354.

The wheel support element 386 may be formed to engage the airframe 28. For example, as shown in FIGS. 24-27, the wheel support element 386 may include a gripping region 389, which may be configured to frictionally and/or mechanically engage the first and second sides 114, 116 of the fuselage 44 and/or the first and second sides 346, 352 of the power unit mount 40. In some examples, the gripping region 389 may be sized such that it induces a compressive force into the fuselage 44 and/or the power unit mount 40. The compressive force may assist with retaining the wheel support element 386 relative to the airframe 28, such as by slightly deforming and/or slightly crushing the fuselage 44 and/or the power unit mount 40.

Figures 23, 24:
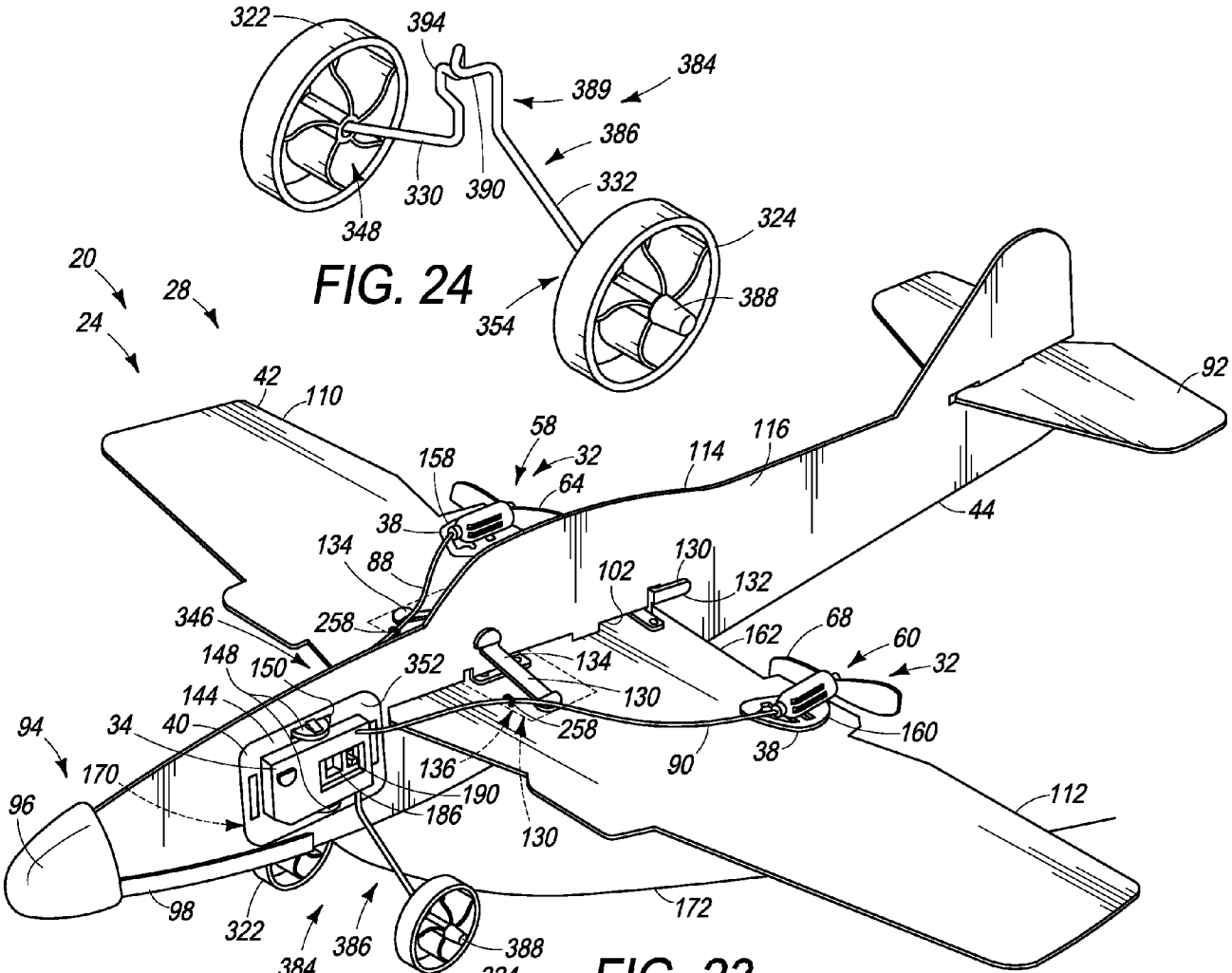
FIG. 23 is a perspective view of a toy aircraft incorporating a modular power system and another nonexclusive illustrative example of a wheel assembly.
FIG. 24 is a perspective view of the wheel assembly of the toy aircraft of FIG. 23.
Figure 25:
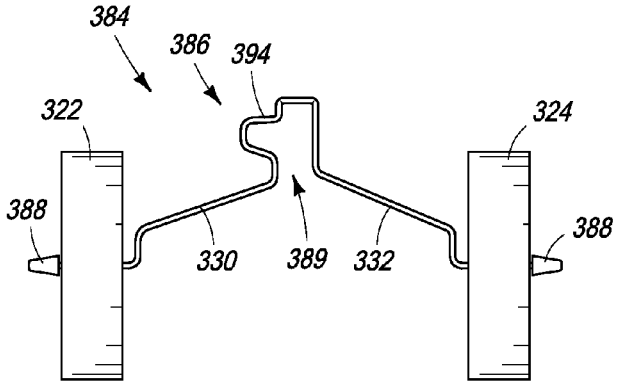
FIG. 25 is a front view of the wheel assembly of FIG. 24.
Figure 26:
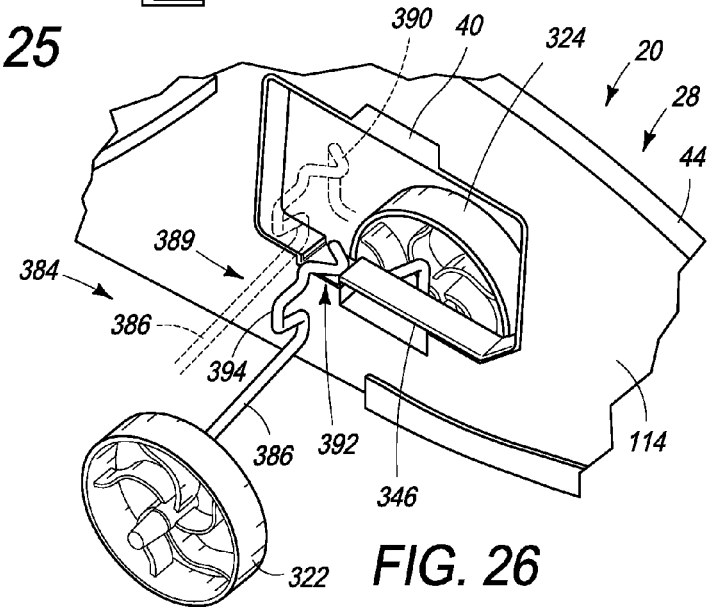
FIG. 26 is a perspective view showing the wheel assembly attached to the toy aircraft of FIG. 23, with the power unit removed.
Figure 27:
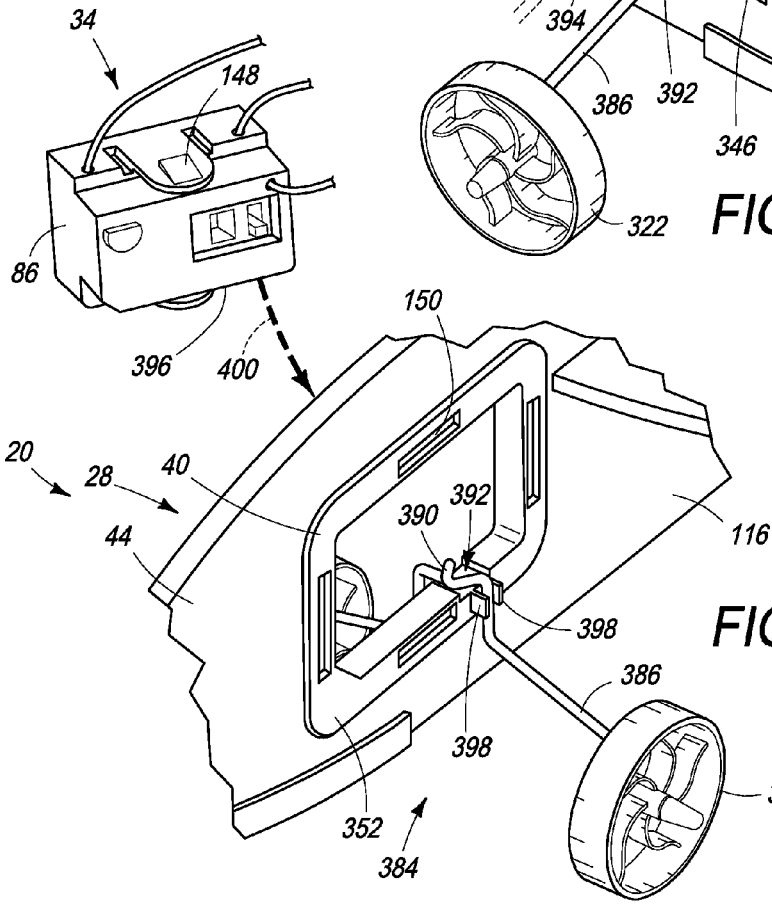
FIG. 27 is another perspective view showing the wheel assembly attached to the toy aircraft of FIG. 23, and showing insertion of the power unit.

The wheel support element 386 may include at least one supporting feature configured to assist with maintaining the wheel support element 386 in a suitable position. The supporting features may resist and/or reduce bending or rotation of the wheel support element 386, such as bending and/or rotation about an axis that is perpendicular to the fuselage 44. For example, as shown in FIG. 24, the wheel support element 386 may include a horizontal extension or nose 390. The nose 390 may engage a suitable portion of the power unit mount 40, such as a notch or recess 392 in a lower surface of the opening 146 in the power unit mount 40, as shown in FIGS. 26 and 27. The recess 392 may provide clearance between the wheel support element 386 and the housing 86 of the power unit 34. As shown in FIGS. 24 and 25, the wheel support element 386 may additionally or alternatively include a side extension 394. The side extension 394 may be configured to engage a lower surface 396 of the housing 86, which may include a corresponding slot or indentation.

The power unit mount 40 may include at least one mounting feature configured to assist with maintaining the wheel support element 386 in a suitable position. The mounting features may resist and/or reduce bending or rotation of the wheel support element 386, such as bending and/or rotation about an axis that is perpendicular to the fuselage 44. For example, as shown in FIG. 27, the power unit mount 40 may include a pair of projecting guide members 398, which may engage the wheel support element 386.

The wheel assembly 384 may be selectively mounted on the toy aircraft 20 by inserting one of the first and second wheels 322, 324 and a portion of the wheel support element 386 through the opening 146. The wheel support element 386 may be positioned such that the nose 390 is aligned with the recess 392, as suggested by the dashed lines in FIG. 26, and the wheel support element 386 is aligned with the guide members 398. The wheel support element 386 may be moved downward into its mounted position, as shown in FIGS. 26 and 27, with the nose 390 in the recess 392 and the wheel support element 386 engaged with the guide members 398. The power unit 34 may be inserted into the opening 146, as suggested by the arrow 400 in FIG. 27.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A toy aircraft having an aircraft frame, the aircraft frame comprising:
- an aircraft wing;
- a wing support clip including:
  - a wing support clip body,
  - a backing clip engagement pin on the wing support clip body,
  - a first wing support clip socket on the wing support clip body configured to engage a first wing support clip engagement pin, and
  - a second wing support clip socket on the wing support clip body configured to engage a second wing support clip engagement pin;
- a backing clip including:
  - a backing clip body, and
  - a wing support clip engagement socket on the backing clip body removably engaged with the backing clip engagement pin through a hole in the aircraft wing;
- an aircraft fuselage;
- a first wing strut including:
  - a first wing strut body,
  - a first wing support clip engagement pin on the first wing strut body configured to removably engage the first wing support clip socket, and
  - a strut attachment pin on the first wing strut body; and
- a second wing strut including:
  - a second wing strut body,
  - a second wing support clip engagement pin on the second wing strut body configured to removably engage the second wing support clip socket, and
  - a strut attachment socket on the second wing strut body removably engaged with the strut attachment pin through a hole in the aircraft fuselage.

2. A toy aircraft having an aircraft frame, the aircraft frame comprising:
- a wing support clip including:
  - a wing support clip body,
  - a backing clip engagement pin on the wing support clip body,
  - a first wing support clip socket on the wing support clip body configured to engage a first wing support clip engagement pin, and
  - a second wing support clip socket on the wing support clip body configured to engage a second wing support clip engagement pin; and
- a backing clip including:
  - a backing clip body, and
  - a wing support clip engagement socket on the backing clip body removably engaged with the backing clip engagement pin through a hole in an aircraft wing.

3. The toy aircraft of claim 2 where the wing support clip engagement socket frictionally or mechanically engages and retains the backing clip engagement pin.

4. The toy aircraft of claim 2 where the wing support clip body includes outer portions that are coplanar to each other.

5. The toy aircraft of claim 2 where the wing support clip body includes outer portions angled relative to each other.

6. The toy aircraft of claim 5 where the wing support clip is secured to a lower surface of the aircraft wing.

7. The toy aircraft of claim 5 where the wing support clip is secured to an upper surface of the aircraft wing.

8. The toy aircraft of claim 2 where the wing support clip further includes:

a first arm including a fuselage attachment pin, and a second arm including a fuselage attachment socket.

9. The toy aircraft of claim 8 where the fuselage attachment socket is configured for frictional or mechanical engagement with the fuselage attachment pin through a hole in an aircraft fuselage.

10. The toy aircraft of claim 8 where the first arm and the second arm are connected to a central portion of the wing support clip by regions of reduced thickness on the wing support clip body.

11. A toy aircraft having an aircraft frame, the aircraft frame comprising:

a first wing strut including:

a first wing strut body, a first wing support clip engagement pin on the first wing strut body configured to removably engage a first wing support clip socket, and a strut attachment pin on the first wing strut body; and a second wing strut including:

a second wing strut body, a second wing support clip engagement pin on the second wing strut body configured to removably engage a second wing support clip socket, and a strut attachment socket on the second wing strut body removably engaged with the strut attachment pin through a hole in an aircraft fuselage.

12. The toy aircraft of claim 11 where the strut attachment socket frictionally or mechanically engages and retains the strut attachment pin.

13. The toy aircraft of claim 11 where the first wing strut body includes an end region and a central portion, and the end region is flexibly connected to the central portion.

14. The toy aircraft of claim 13 where the end region includes one of the strut attachment pin and the first wing support clip engagement pin.

15. The toy aircraft of claim 13 where the end region is flexibly connected to the central portion by a region of reduced thickness on the first wing strut body.

16. The toy aircraft of claim 11 where the second wing strut body includes an end region and a central portion, and the end region is flexibly connected to the central portion.

17. The toy aircraft of claim 16 where the end region includes one of the strut attachment socket and the second wing support clip engagement pin.

18. The toy aircraft of claim 16 where the end region is flexibly connected to the central portion by a region of reduced thickness on the second wing strut body.

* * * * *